US006884128B2

(12) United States Patent
Okuyama et al.

(10) Patent No.: US 6,884,128 B2
(45) Date of Patent: Apr. 26, 2005

(54) SPEED CONTROL SYSTEM AND METHOD FOR WATERCRAFT

(75) Inventors: Takashi Okuyama, Hamamatsu (JP); Takashi Sugimoto, Tokyo (JP); Makoto Itoi, Tokyo (JP)

(73) Assignees: Yamaha Marine Kabushiki Kaisha, Shizuoka (JP); Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/691,754

(22) Filed: Oct. 23, 2003

(65) Prior Publication Data

US 2004/0242091 A1 Dec. 2, 2004

(30) Foreign Application Priority Data

Oct. 23, 2002 (JP) ..... 2002-307950

(51) Int. Cl.[7] ..... B63H 21/22

(52) U.S. Cl. ..... 440/1; 440/84

(58) Field of Search ..... 440/1, 84

(56) References Cited

U.S. PATENT DOCUMENTS

| | | | | |
|---|---|---|---|---|
| 5,209,682 A | | 5/1993 | Duning et al. | 440/2 |
| 5,295,877 A | | 3/1994 | Kanno | 440/2 |
| 5,366,394 A | | 11/1994 | Kanno | 440/2 |
| 5,606,952 A | | 3/1997 | Kanno et al. | 123/413 |
| 5,713,428 A | * | 2/1998 | Linden et al. | 180/179 |
| 6,755,177 B2 | * | 6/2004 | Woolford et al. | 123/333 |
| 2003/0013354 A1 | * | 1/2003 | Yanagihara | 440/1 |

FOREIGN PATENT DOCUMENTS

| | | |
|---|---|---|
| JP | 6-26878 | 2/1994 |
| JP | 2001-152898 | 6/2001 |
| JP | 2001-265406 | 9/2001 |

OTHER PUBLICATIONS

International Standard, ISO 11783–5, First edition Jan. 5, 2001, Tractors and machinery for agriculture and forestry–Serial control and communications data network, Part 5: Network management.

NMEA 2000; Standard for Serial Data Networking of Marine Electronic Devices; Main Document; Version 1.000, Sep. 12, 2001; @NMEA 1999, 2000, 2001.

NMEA 2000; Standard for Serial Data Networking of Marine Electronic Devices; Appendix A; Version 1.000; Sep. 12, 2001; @NMEA 1999, 2000, 2001.

NMEA 2000; Standard for Serial Data Networking of Marine Electronic Devices; Appendix B; @NMEWA 1999, 2000, 2001.

(Continued)

*Primary Examiner*—Jesus D. Sotelo
(74) *Attorney, Agent, or Firm*—Knobbe, Martens, Olson & Bear, LLP

(57) ABSTRACT

A watercraft has an engine and a remote controller. The engine has a throttle valve unit. The remote controller provides a command signal indicative of a position of the throttle valve unit. A watercraft velocity sensor senses an actual speed of the watercraft to provide an actual speed signal. A control data input device selectively provides a control device with a manual mode signal and a constant speed mode signal. The constant speed mode signal is accompanied by a target speed signal. The control device controls the throttle valve unit based upon the command signal in the manual mode. The control device controls the throttle valve unit in the constant speed mode such that an actual speed of the watercraft coincides with the target speed of the watercraft once a state of equilibrium is reached. The control device starts the manual mode in place of the constant speed mode without the manual mode signal if the command signal changes while the control device controls the throttle valve unit in the constant speed mode.

32 Claims, 12 Drawing Sheets

OTHER PUBLICATIONS

NMEA 2000; Standard for Serial Data Networking of Marine Electronic Devices; Appendix C; Version 1.000, Sep. 12, 2001, @NMEA 1999, 2000, 2001.

NMEA 2000; Standard for Serial Data Networking of Marine Electronic Devices; Appendix D; Version 1.000, Sep. 12, 2001, @NMEA 1999, 2000, 2001.

NMEA 2000; Standard for Serial Data Networking of Marine Electronic Devices; Appendix E; ISO 11783–5 Network Management.

NMEA 2000; Standard for Serial Data Networking of Marine Electronic Devices; Appendix F; ISO 11783–3 DataLink Layer.

NMEA 2000; Standard for Serial Data Networking of Marine Electronic Devices; Appendix G; ISO 11898 Controller Area Network.

Co–pending U.S. Appl. No. 10/675,340, filed Sep. 30, 2003, Takashi Okuyama "Steering Control System And Method For Watercraft.".

Co–pending U.S. Appl. No. 10/624,204, filed Jul. 22, 2003, Takashi Okuyama, "Control Circuits and Methods For Inhibiting Abrupt Engine Mode Transitions In a Watercraft."

Co–pending U.S. Appl. No. 10/624,984, filed Jul. 22, 2003, Takashi Okuyama, "Engine Starting System For Multiple Engines."

Co–pending U.S. Appl. No. 10/619,095, filed Jul. 11, 2002, Takashi Okuyama, "Multiple Node Network And Communication Method Within The Network."

Toyota Camry 2000 Owner's Manual, 1999, pp. i, .95, 102–104.

* cited by examiner

SPEED CONTROL SYSTEM AND METHOD FOR WATERCRAFT

PRIORITY INFORMATION

The present application is based on and claims priority under 35 U.S.C. § 119 to Japanese Patent Application No. 2002-307950, filed on Oct. 23, 2002, the entire content of which is expressly incorporated by reference herein.

BACKGROUND OF THE INVENTION

1. Field of the Invention

The present invention generally relates to a speed control system and method for a watercraft, and more particularly relates to an improved speed control system and method that controls a speed of a watercraft selectively using at least two control modes.

2. Description of Related Art

Computerized controls have become popular in recent years for watercrafts. In one arrangement, a watercraft has a propulsion device that propels the watercraft. Typically, an outboard motor can have such a propulsion device that is powered by an engine. An air intake device for the engine can incorporate a throttle valve unit that has a throttle valve to regulate an amount of air or rate of airflow to the engine and an actuator to actuate the throttle valve. The actuator moves the throttle valve generally between a fully closed position and a fully open position under control of a control device. The engine generates an output in accordance with the open position or open degree of the throttle valve. Normally, the greater the open degree, the higher the rate of airflow and the higher the engine speed. A speed or velocity of the watercraft varies generally in accordance with the engine speed.

A computerized speed control system that has the control device can be applied to the throttle valve unit. The speed control system typically has, for example, a manual control mode and a constant speed mode. In the manual control mode, the throttle valve unit is manually controllable and can be set at any position to vary the speed of the watercraft. In the constant speed mode, the throttle valve unit is automatically held at a certain position to keep the watercraft in a desired and substantially constant speed. A mode selector can be provided to allow the operator to select the manual control mode or the constant speed mode.

The speed control system is convenient for a planing boat used for waterskiing, wake boarding, or hydrosliding. Typically, an operator of the boat accelerates an engine, which is typically incorporated in an outboard motor mounted on the boat, in the manual control mode and brings the boat to a target speed that is suitable for waterskiing, wake board riding, or hydrosliding. The operator then selects the constant speed mode to keep the speed of the boat at the target speed.

Such a computerized speed control system and method is disclosed, for example, in JP2001-152898.

The speed control system is advantageous because the operator does not need to manually adjust the throttle lever to maintain the boat's speed substantially constant. On the other hand, however, the conventional speed control system is sometimes inconvenient. For example, the operator of the watercraft generally must decelerate the boat and circle back when the person being towed falls or releases the tow rope. In order to do so, the operator typically must operate the mode selector to switch to the manual control mode from the constant speed mode. This operation is not only burdensome for the operator but also takes time, causing an undesirable delay before deceleration occurs. This delay may also be problematic in other scenarios in which the operator needs to desires to rapidly adjust the boat's speed.

SUMMARY OF THE INVENTION

One embodiment of the present invention provides a speed control system and method for a watercraft that does not require the operator to operate a mode selector in switching to the manual control mode from the constant speed mode. The control system in the embodiment releases the constant speed mode whenever the operator operates an operating device such as, for example, a remote controller and allows the operator to control the speed of the watercraft in the manual control mode.

In accordance with one aspect of the present invention, a watercraft comprises a propulsion device arranged to propel the watercraft. A prime mover powers the propulsion device. A regulating device regulates an output of the prime mover. The watercraft can proceed generally at a speed corresponding to the output of the prime mover. A command input device provides a command signal to control the regulating device. A speed sensing device senses an actual speed of the watercraft and provides an actual speed signal. A control device controls the regulating device. A control data input device selectively provides the control device with a first mode signal that starts a first mode of the control device and a second mode signal that starts a second mode of the control device. The first mode is a manual control mode in which a human operator manually controls a speed of the watercraft. The second mode is a mode in which the speed is controlled automatically. The second mode signal is accompanied by a target speed signal indicative of a target speed of the watercraft. The control device controls the regulating device based upon the command signal in the first mode. The control device controls the regulating device in the second mode such that an actual speed of the watercraft designated by the actual speed signal generally corresponds with the target speed of the watercraft designated by the target speed signal. The control device starts the first mode in place of the second mode without the first mode signal if the command signal changes while the control device controls the regulating device in the second mode.

In accordance with another aspect of the present invention, a watercraft comprises a propulsion device arranged to propel the watercraft. A prime mover powers the propulsion device. A regulating device regulates an output of the prime mover. The watercraft can proceed generally at a speed corresponding to the output of the prime mover. A command input device provides a command signal to control the regulating device. A speed sensing device senses an actual speed of the watercraft to provide an actual speed signal. A control device controls the regulating device. A control data input device selectively provides the control device with a first mode signal that starts a first mode of the control device and a second mode signal that starts a second mode of the control device. The second mode signal is associated with a target speed signal indicative of a target speed of the watercraft. The control device controls the regulating device based upon the command signal in the first mode. The control device controls the regulating device in the second mode such that an actual speed of the watercraft designated by the actual speed signal generally corresponds with the target speed of the watercraft designated by the target speed signal. The control device controls the regulating device based upon the command signal if the command signal changes while the control device controls the regulating device in the second mode.

In accordance with a further aspect of the present invention, a watercraft comprises a propulsion device arranged to propel the watercraft. An engine powers the propulsion device. An air intake device delivers air to the engine. A throttle valve unit regulates an amount of the air. An output of the engine generally varies in response to the amount of the air. The watercraft can proceed generally at a speed corresponding to the output of the engine. A command input device provides a command signal indicative of a position of the throttle valve unit. A speed sensing device senses an actual speed of the watercraft and provides an actual speed signal. A control device controls the throttle valve unit. A control data input device selectively provides the control device with a first mode signal that starts a first mode of the control device and a second mode signal that starts a second mode of the control device. The second mode signal is associated with a target speed signal indicative of a target speed of the watercraft. The control device controls the throttle valve unit based upon the command signal in the first mode. The control device controls the throttle valve unit in the second mode such that an actual speed of the watercraft designated by the actual speed signal generally corresponds with the target speed of the watercraft designated by the target speed signal. The control device starts the first mode in place of the second mode without the first mode signal if the command signal changes while the control device controls the throttle valve unit in the second mode.

In accordance with a further aspect of the present invention, a velocity control system for a watercraft comprises a command input device that provides a command signal to control a regulating device that regulates an output of a prime mover of the watercraft. A speed sensing device senses an actual speed of the watercraft to provide an actual speed signal. A control device controls the regulating device. A control data input device selectively provides the control device with a first mode signal that starts a first mode of the control device and a second mode signal that starts a second mode of the control device. The second mode signal is accompanied by a target speed signal indicative of a target speed of the watercraft. The control device controls the regulating device based upon the command signal in the first mode. The control device controls the regulating device in the second mode such that an actual speed of the watercraft designated by the actual speed signal generally corresponds to the target speed of the watercraft designated by the target speed signal. The control device starts the first mode in place of the second mode without the first mode signal if the command signal changes while the control device controls the regulating device in the second mode.

In accordance with a further aspect of the present invention, a computer-implemented control method is provided for controlling a speed of a watercraft. The method comprises regulating an output of a prime mover that powers a propulsion device of the watercraft, generating a command signal, sensing an actual speed of the watercraft to generate an actual speed signal, generating a first mode signal that starts a first mode, generating a second mode signal that starts a second mode, generating a target speed signal indicative of a target speed of the watercraft, controlling the regulation of the output of the prime mover based upon the command signal in the first mode, controlling the regulation of the output of the prime mover in the second mode such that an actual speed designated by the actual speed signal generally coincides with a target speed designated by the target speed signal, determining whether the command signal changes while controlling the regulation of the output of the prime mover in the second mode, and starting the first mode in place of the second mode without the first mode signal if the determination is positive.

In accordance with a further aspect of the present invention, a control method is provided for controlling a speed of a watercraft. The method comprises regulating an output of a prime mover that powers a propulsion device of the watercraft, generating a command signal, sensing an actual speed of the watercraft to generate an actual speed signal, generating a first mode signal that starts a first mode, generating a second mode signal that starts a second mode, generating a target speed signal indicative of a target speed of the watercraft, controlling the regulation of the output of the prime mover based upon the command signal in the first mode, controlling the regulation of the output of the prime mover in the second mode such that an actual speed designated by the actual speed signal generally coincides with a target speed designated by the target speed signal, determining whether the command signal changes while controlling the regulation of the output of the prime mover in the second mode, and controlling the regulation of the output of the prime mover based upon the command signal if the determination is positive.

In accordance with a further aspect of the present invention, a speed control system for a watercraft comprises a speed control system that automatically controls a speed of the watercraft according to a pre-specified target speed setting when the watercraft is in a regulated speed mode. A mode control switch is operable by an operator to switch the watercraft into and out of the regulated speed mode. A speed of the watercraft is controlled according to a position of a throttle lever when the watercraft is not in the regulated speed mode. A controller is responsive to operator movement of the throttle lever with the watercraft in the regulated speed mode by taking the watercraft out of the regulated speed mode to allow the operator to control the watercraft's speed manually, whereby the operator can take the watercraft out of the regulated speed mode by movement of the throttle lever without operating the mode control switch.

In accordance with a further aspect of the present invention, a computer-implemented method of operating a watercraft comprises controlling a speed of the watercraft automatically in a regulated speed mode according to a pre-specified target speed specified by an operator; and responding to movement by the operator of a throttle lever of the watercraft by disabling the regulated speed mode to allow the operator to manually adjust a speed of the watercraft with the throttle lever.

BRIEF DESCRIPTION OF THE DRAWINGS

The foregoing and other features, aspects and advantages of the present invention are described in detail below with reference to the drawings of preferred embodiments which are intended to illustrate and not to limit the invention. The drawings comprise twelve figures in which.

DETAILED DESCRIPTION OF THE PREFERRED EMBODIMENTS OF THE INVENTION

With reference to FIGS. 1–7, a watercraft 30 configured in accordance with certain features, aspects and advantages of the present invention is described below. Although the watercraft 30 includes a communication network 32 in the illustrated embodiment, those skilled in the art will appreciate that the invention may be practiced without the use of a network. In addition, although the decision logic in the preferred embodiment is distributed across multiple nodes, a centralized (non-distributed) computing architecture may alternatively be used in which most of the functionality of the nodes is implemented within a program executed by a single computer processor.

Figure 1:
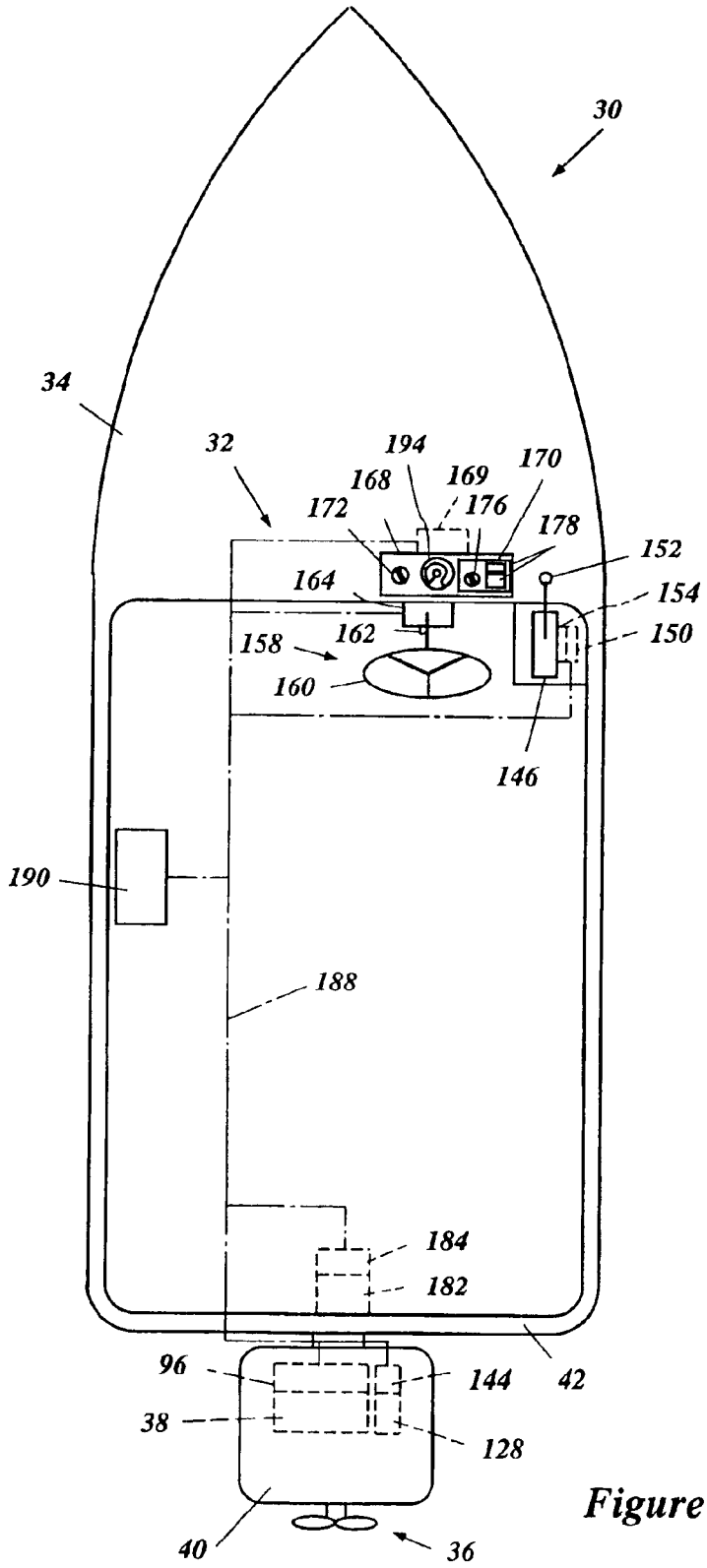
FIG. 1 illustrates a schematic representation of a top plan view of a watercraft configured in accordance with certain features, aspects and advantages of the present invention, including as part of the watercraft an outboard motor that has an engine, wherein an engine control unit and a remote controller are electrically connected with each other through a network.

With reference to FIG. 1, the watercraft 30 has a hull 34. The watercraft 30 also has a propulsion device 36 that propels the hull 34 and an internal combustion engine 38 that powers the propulsion device 36. In the illustrated embodiment, an outboard motor 40 mounted on a transom 42 of the hull 34 incorporates the propulsion device 36 and the engine 38. Other marine drives such as, for example, stem drives can replace the outboard motor 36. Also, other prime movers such as, for example, an electric motor can replace the engine 38 to power the propulsion device. Multiple outboard motors 40, or other types of motors may be mounted to the hull 34 and used concurrently.

Figure 3:
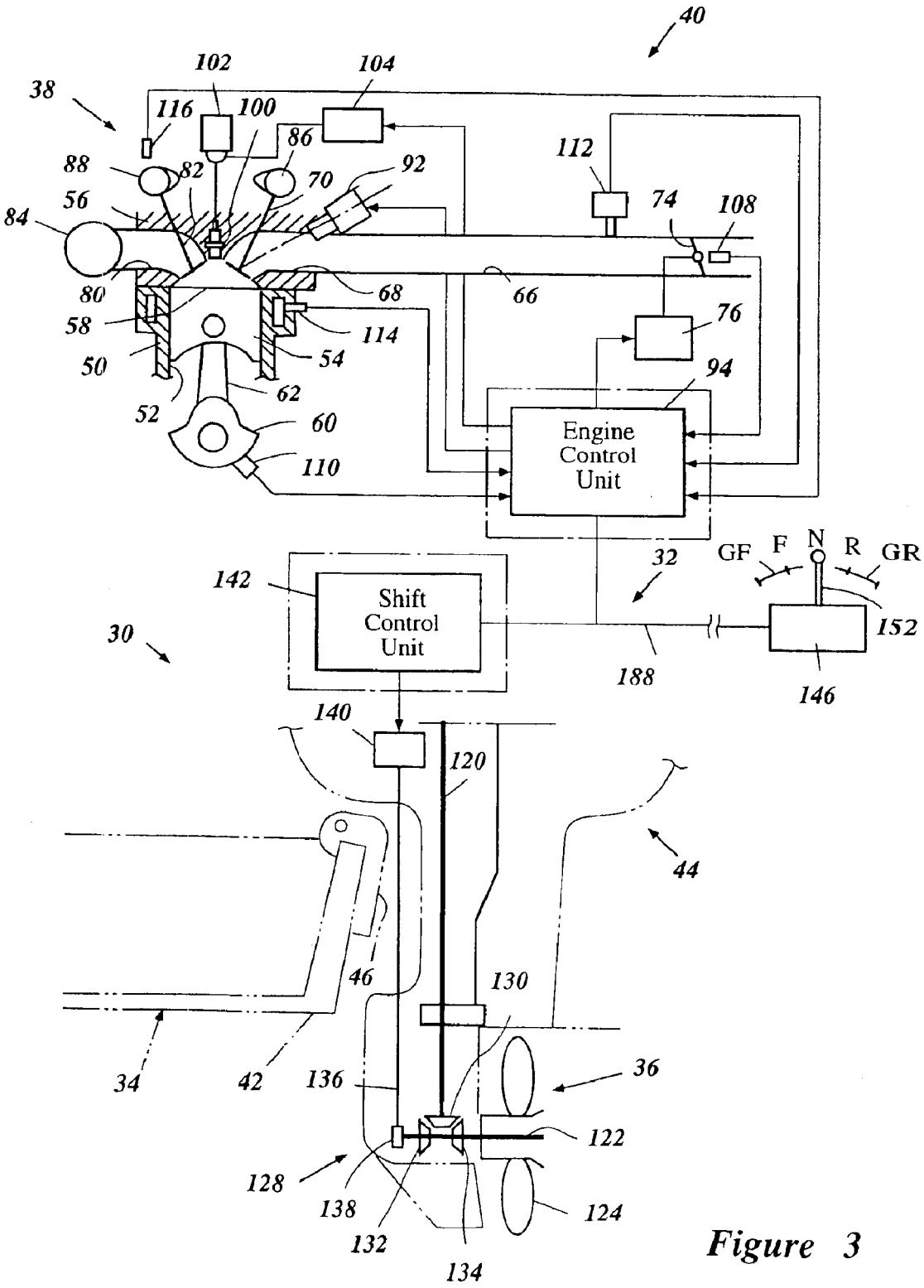
FIG. 3 illustrates a schematic representation of a side elevational view of the outboard motor of FIG. 1, particularly showing the engine, the engine control unit, a transmission and a shift control unit.

With reference to FIG. 3, the outboard motor 40 comprises a housing unit 44 and a bracket assembly 46. The bracket assembly 46 supports the housing unit 44 on a transom 42 of the hull 34 so as to place the propulsion device 36, which is disposed on a lower portion of the housing unit 44, in a submerged position with the watercraft 30 resting on the surface of a body of water. The bracket assembly 46 preferably comprises a swivel bracket, a clamping bracket, a steering shaft and a pivot pin.

The steering shaft preferably extends through the swivel bracket and is affixed to the housing unit 44. The steering shaft is pivotally journaled for steering movement about a generally vertically extending steering axis defined within the swivel bracket. Because the lower portion of the housing unit 44 normally is in the submerged position and the housing unit 44 together with the steering shaft can pivot about the axis of the steering shaft, the housing unit can act as a rudder. Although not shown, a steering mechanism can be incorporated to turn the steering shaft with the housing unit 44 relative to the hull 34. The steering mechanism preferably includes a steering actuator, which can be a servomotor, to drive the steering mechanism.

The clamping bracket comprises a pair of bracket arms that are spaced apart from each other and that are affixed to the watercraft transom 42. The pivot pin completes a hinge coupling between the swivel bracket and the clamping bracket. The pivot pin extends through the bracket arms so that the clamping bracket supports the swivel bracket for pivotal movement about a generally horizontally extending tilt axis defined by the pivot pin. The housing unit 44 thus can be tilted or trimmed about the pivot pin.

As used through this description, the terms "forward," "forwardly" and "front" mean at or to the side where the bracket assembly 46 is located, and the terms "rear," "reverse," "backwardly" and "rearwardly" mean at or to the opposite side of the front side, unless indicated otherwise or otherwise readily apparent from the context of use.

The engine 38 is disposed atop the housing unit 44. The engine 38 preferably operates according to a four-cycle combustion principle. The engine 38 comprises a cylinder block 50 that defines four cylinder bores 52. A piston 54 can reciprocate in each cylinder bore 52. A cylinder head assembly 56 is affixed to the cylinder block 50 to close one end of the cylinder bores 52. The cylinder head assembly 56, in combination with the cylinder bores 52 and the pistons 54, define four combustion chambers 58. The cylinder head assembly 56 is disposed on the rear side of the engine 38 relative to the bracket assembly 46.

The other end of the cylinder block 50 is closed with a crankcase member that at least partially defines a crankcase chamber. A crankshaft 60 extends generally vertically through the crankcase chamber. The crankshaft 60 is connected to the pistons 54 by connecting rods 62 and is rotated by the reciprocal movement of the pistons 54.

The engine 38 preferably is provided with an air intake system to introduce air to the combustion chambers 58. The air intake system preferably includes a plenum chamber, air intake passages 66 and intake ports' 68 that are formed in the cylinder block 50. The air intake passages 66 and the intake ports 68 are associated with the respective combustion chambers 58. The intake ports 68 are defined in the cylinder head assembly 56 and are repeatedly opened and closed by intake valves 70. When the intake ports 68 are opened, the air intake passages 66 communicate with the associated combustion chambers 58.

The engine 38 is covered with a protective cowling that has an air intake opening. Ambient air is drawn into a cavity of the cowling around the engine 38 through the air intake opening. The air in the cavity is drawn into the respective air intake passages 66 through the plenum chamber. Because the intake passages 66 can communicate with the combustion chambers 58 when the intake valves 70 are opened, the air can enter the respective combustion chambers 58 at the open timing of the intake valves 70.

A throttle valve 74 preferably is disposed within each air intake passage 66 downstream of the plenum chamber to regulate an amount of air or airflow rate to each combustion chamber 58. The throttle valve 74 preferably is a butterfly type valve and moves generally between a fully closed position and a fully open position. The throttle valves 74 preferably have a common valve shaft journaled for pivotal movement. A certain amount of air is admitted to pass through the intake passage 66 in accordance with an angular position or open degree of the throttle valve 74 when the valve shaft pivots. The angular position is a throttle valve position of the throttle valves 74 in this embodiment.

A throttle valve actuator 76 preferably is coupled with the valve shaft to actuate the throttle valves 74. A servomotor preferably forms the actuator 76. Normally, an air amount or rate of airflow increases when the open degree of the throttle valves 74 increases. Unless the environmental circumstances change, an engine speed of the engine 38, as an output of the engine 38, increases generally along with the increase of the air amount.

In the illustrated embodiment, the throttle valves 74 and the throttle valve actuator 76 together form a regulating device that regulates an output of the engine 38. If an electric motor is used as the prime mover, an exciting coil of the electric motor, for example, can form the regulating device.

The engine 38 preferably is provided with an exhaust system to discharge burnt charges or exhaust gases to a location outside of the outboard motor 40 from the combustion chambers 58. Exhaust ports 80 are defined in the cylinder head assembly 56 and are repeatedly opened- and closed by exhaust valves 82. An exhaust manifold 84 is connected to the exhaust ports 80 to collect the exhaust gases. The combustion chambers 58 communicate with the exhaust manifold 84 when the exhaust ports 80 are opened. The exhaust gases are discharged to a body of water that surrounds the outboard motor 40 through the exhaust manifold 84 and exhaust passages formed in the housing unit 44 when the engine 38 operates above idle. The exhaust gases also are directly discharged into the atmosphere through the exhaust manifold 84, an idle exhaust passage and an opening formed at the housing unit 44 when the engine 38 operates at idle.

An intake camshaft 86 and an exhaust camshaft 88 preferably are journaled for rotation and extend generally vertically in the cylinder head assembly 56. The intake camshaft 86 actuates the intake valves 70 while the exhaust camshaft 88 actuates the exhaust valves 82. The camshafts 86, 88 have cam lobes to push the respective valves 70, 82. Thus, the associated ports 68, 80 communicate with the combustion chambers 58 when the cam lobes push the valves 70, 82. Each camshaft 86, 88 and the crankshaft 60 preferably have a sprocket. A timing belt or chain is wound around the respective sprockets in this arrangement. Accordingly, the crankshaft 60 can drive the camshafts 86, 88 by the timing belt or chain.

The illustrated engine 38 preferably has a fuel injection system. The fuel injection system employs four fuel injectors 92 allotted for each combustion chamber 58. The fuel is reserved in a fuel tank and is pressurized by multiple fuel pumps, although FIG. 3 schematically illustrates only one fuel injector 92. Each fuel injector 92 preferably is affixed to the cylinder head assembly 56 with a nozzle exposed into each intake port 68. The nozzle of each fuel injector 92 is directed to the associated combustion chamber 58.

The fuel injectors 92 preferably spray fuel into the intake ports 68 when the intake valves 70 are opened under control of an engine control unit 94. The sprayed fuel enters the combustion chambers 58 together with the air that passes through the intake passages 66. An amount of the sprayed fuel is determined by the engine control unit 94 in accordance with the amount of the air regulated by the throttle valves 74 to keep a proper air/fuel ratio. Preferably, a fuel pressure is strictly managed by the fuel injection system. Thus, the engine control unit 94 determines a duration of the injection to determine the fuel amount. The engine control unit 94 eventually controls the duration and an injection timing of each injection. The engine control unit 94 in this arrangement generally forms a portion of an engine control node 96 of the network system 32, which will be described in greater detail below.

Other types of fuel supply systems are applicable. For example, a direct fuel injection system that sprays fuel directly into the combustion chambers or a carburetor system can be used.

The engine 38 preferably has an ignition or firing system. Each combustion chamber 58 is provided with a spark plug 100. The spark plug 100 is exposed into the associated combustion chamber 58 and ignites an air/fuel charge at a proper ignition timing. The ignition system preferably has ignition coils 102 and igniters 104 which are connected to the engine control unit 94 such that the ignition timing also is under control of the engine control unit 94.

The engine 38 and the exhaust system build much heat. Thus, the outboard motor 40 preferably has a cooling system for the engine 38 and the exhaust system. In the illustrated arrangement, the cooling system is an open-loop type water cooling system. Cooling water is introduced into the system from the body of water and is discharged there after traveling around water jackets in the engine 38 and water passages in the exhaust system. The water jackets preferably are formed in the cylinder block 50 and the cylinder head assembly 56.

As described above, the engine control unit 94 controls at least the throttle valve actuator 76, the fuel injectors 92 and the igniters 104 in the illustrated embodiment. The engine control unit 94 also can control the steering actuator. In order to control those components 76, 92, 104 and the steering actuator, the engine control unit 94 monitors the operation of the engine 38 using sensors.

A throttle valve position sensor 108 preferably is disposed adjacent to at least one of the throttle valves 74 to sense an actual throttle valve position or open degree of the throttle valves 74. A sensed signal THd is sent to the engine control unit 94. Rotary potentiometers or encoders such as, for example, an optical encoder or a magnetic encoder can form the throttle valve position sensor 108.

Associated with the crankshaft 60, a crankshaft angle position sensor 110 preferably is provided to sense a crankshaft angle position and to output a crankshaft angle position signal to the engine control unit 94. The engine control unit 94 can calculate an engine speed using the crankshaft angle position signal versus time. In this regard, the crankshaft angle position sensor 110 and part of the engine control unit 94 together form an engine speed sensor. The crankshaft angle position sensor 110, or another sensor, can also be used to provide reference position data to the engine control unit 94 for timing purposes, such as for the timing of fuel injection and/or ignition timing.

An intake air pressure sensor 112 preferably senses an intake pressure at least in one of the intake passages 66. The sensed signal is sent to the engine control unit 94. This signal, as well as the throttle valve position signal THd, represents an engine load. Additionally or alternatively, an air flow sensor can be disposed in at least one of the intake passages 66 to also sense the engine load.

Other sensors can be added. For example, in one arrangement an engine temperature sensor 114 senses a temperature of the cylinder block 50 and the sensed signal is sent to the engine control unit 94. In one variation, a water temperature sensor placed at one of the water jackets of the cooling system can replace the engine temperature sensor because the water temperature varies generally in accordance with the engine temperature. A cylinder discrimination sensor 116 senses an angle position of the exhaust camshaft 88 and the sensed signal is sent to the engine control unit 94. A steering position sensor also can sense an angular position of the steering shaft.

The sensed signals can be transferred through hard-wired connections, emitter and detector pairs, infrared radiation, radio waves or the like. The type of signal and the type of connection can be varied from one sensor to another or the same type can be used with all sensors.

With continued reference to FIG. 3, the housing unit 44 journals a driveshaft 120 for rotation. The driveshaft 120 extends generally vertically through the housing unit 44. The crankshaft 60 drives the driveshaft 120. The housing unit 44 also journals a propulsion shaft 122 for rotation. The propulsion shaft 122 extends generally horizontally through the lower portion of the housing unit 44. The driveshaft 120 and the propulsion shaft 122 are preferably oriented normal to each other (e.g., the rotation axis of the propulsion shaft 122 is at 90° to the rotation axis of the driveshaft 120). The propulsion shaft 122 drives the propulsion device 36. In the illustrated arrangement, the propulsion device 36 is a propeller 124 that is affixed to an outer end of the propulsion shaft 122. The propulsion device 36, however, can take the form of a dual, a counter-rotating system, a hydrodynamic jet, or any of a number of other suitable propulsion devices.

A changeover mechanism or transmission 128 preferably is provided between the driveshaft 120 and the propulsion shaft 122. The changeover mechanism 128 in this arrangement comprises a drive pinion 130, a forward bevel gear 132 and a reverse bevel gear 134 to couple the two shafts 120, 122. The drive pinion 130 is disposed at the bottom of the driveshaft 120. The forward and reverse bevel gears 132, 134 are disposed on the propulsion shaft 122 and spaced apart from each other. Both bevel gears 132, 134 always mesh with the drive pinion 130. The bevel gears 132, 134, however, race on the propulsion shaft 122 unless fixedly coupled with the propulsion shaft 122.

A dog clutch unit (not shown), which also is a member of the changeover mechanism 128, is slideably but not rotatably disposed between the bevel gears 132, 134 on the propulsion shaft 122 so as to selectively engage the forward bevel gear 132 or the reverse bevel gear 134 or not engage any one of the forward and reverse bevel gears 132, 134. The forward bevel gear 132 or the reverse bevel gear 134 can be fixedly coupled with the propulsion shaft 122 when the dog clutch unit engages the forward bevel gear 132 or the reverse bevel gear 134, respectively.

The changeover mechanism 128 further has a shift rod 136 that preferably extends vertically through the steering shaft. The shift rod 136 can pivot about an axis of the shift rod 136. The shift rod 136 has a shift cam 138 at the bottom. The shift cam 138 abuts a front end of the dog clutch unit. The dog clutch unit thus follows the pivotal movement of the shift cam 138 and slides on the propulsion shaft 122 to engage either the forward or reverse bevel gear 132, 134 or not engage any one of the bevel gears 132, 134.

Engagement states of the forward and reverse bevel gear 132, 134 with the dog clutch unit correspond to operational modes of the propeller 124. The operational modes of the propeller 124 include a forward mode F, a reverse mode R and a neutral mode N. The first engagement state in which the dog clutch unit engages the forward bevel gear 132 corresponds to the forward mode F. The second engagement state in which the dog clutch unit engages the reverse bevel gear 134 corresponds to the reverse mode R. The third engagement state in which the dog clutch unit does not engage the forward bevel gear 132 or the reverse bevel gear 134 corresponds to the neutral mode N. In the forward mode F, the propeller 124 rotates in a right rotational direction that propels the watercraft 30 forwardly. In the reverse mode R, the propeller 124 rotates in a reverse rotational direction that propels the watercraft 30 backwardly. In the neutral mode N, the propeller 124 does not rotate and does not propel the watercraft 30. In this description, the operational mode of the propeller 124 may be called a "shift mode." Also, the engagement state of the dog clutch unit may be called a "shift position."

In the illustrated embodiment, a shift rod actuator 140, which preferably is a servo motor, is coupled with the top end of the shift rod 136 to pivot the shift rod 136. The shift rod actuator 140 is under control of a shift control unit 142. The shift control unit 142 in this arrangement generally forms a portion of a shift control node 144 (FIG. 1) of the network system 32. The shift-control unit 142 commands the shift rod actuator 140 to actuate the shift rod 136. The shift cam 138 thus brings the dog clutch unit into the first, second or third engagement state (i.e., forward shift position F, reverse shift position R or neutral shift position N).

As described above, the shift control unit 142 controls at least the shift rod actuator 140 in the illustrated embodiment. In order to control the shift rod actuator 140, the shift control unit 142 monitors at least an actual angular position of the shift rod 136. The outboard motor 40 thus has a shift rod angle position sensor (not shown) adjacent to the shift rod 136. Rotary potentiometers or encoders such as, for example, an optical encoder or a magnetic encoder can form the shift rod angle position sensor. The sensed signal is sent to the shift control unit 142.

With reference to FIGS. 1 and 3, the operator can input a certain throttle valve position command THr to the engine control unit 94 and a shift position command to the shift control unit 142 through an operating device. The operating device in this embodiment is a remote controller 146 that preferably is disposed on the right-hand side of a cockpit of the watercraft 30. The cockpit is disposed generally at a center position of a deck 148 (FIG. 2) which forms a upper portion of the hull 34. The remote controller 146 forms a portion of a remote controller node 150 of the network system 32.

The remote controller 146 preferably has a control lever 152 that is journaled on a housing of the remote controller 146 for pivotal movement. The control lever 152 is operable by the operator so as to pivot between two limit ends. A reverse acceleration range GR, a reverse troll position R, a neutral position N, a forward troll position F and a forward acceleration range GF can be selected in this order between the limit ends. That is, one limit end corresponds to a most accelerated position of the reverse acceleration range GR and the other limit end corresponds to a most accelerated position of the forward acceleration range GF. The reverse troll position R is consistent with a least accelerated position of the reverse acceleration range GR, while the forward troll position F is consistent with a least accelerated position of the forward acceleration range GF. Preferably, the control lever 152 stays at any position between the limit ends unless the operator operates the lever 152.

A control lever angle position sensor 154 is disposed adjacent to the control lever 152 to sense an angle position of the control lever 152. The sensed signal is transferred to the engine control unit 94 and the shift control unit 142 through the network system 32. Rotary potentiometers or encoders such as, for example, an optical encoder or a magnetic encoder can form the control lever angle position sensor 154.

The remote controller 146 preferably provides the engine control unit 94 and the shift control unit 142 with the throttle valve position command THr and a shift position command, respectively, in accordance with an angle position or rotational angle degree of the control lever 152 through the network system 32.

More specifically, the position of the control lever 152 within the reverse acceleration range GR designates the reverse shift position (reverse mode) R and a throttle valve position between the fully closed position and the fully open position. In this state, the propeller 124 rotates in the reverse direction and at an accelerated speed corresponding to the engine speed.

The position of the control lever 152 at the reverse position R designates the reverse shift position (reverse mode) R and a throttle valve position at the fully closed position. In this state, the propeller 124 rotates in the reverse direction and in a troll speed. The troll speed preferably is a speed corresponding to the idle engine speed. The reverse troll position R substantially is equal to the least accelerated position of the reverse acceleration range GR. Additionally, the reverse troll position R preferably provides a reference level of an actual shift position.

The position of the control lever 152 at the forward position F designates the forward shift position (forward mode) F and a throttle valve position at the fully closed position. In this state, the propeller 124 rotates in the forward direction and in the troll speed The position of the control lever 152 within the forward acceleration range GF designates the forward shift position (forward mode) F and a throttle valve position between the fully closed position and the fully open position. In this state, the propeller 124 rotates in the forward direction and at an accelerated speed corresponding to the engine speed. The forward troll position F substantially is equal to the least accelerated position of the forward acceleration range GF.

In one alternative, the remote controller 146 can have two control levers which provide the throttle valve position command THr and the shift position command to the engine control unit 94 and the shift control unit 142, respectively. In another alternative, stick or sticks which are slideably disposed can replace the control lever or levers, respectively.

With reference back to FIG. 1, a steering device 158 preferably is placed at a center of the cockpit. The steering device 158 incorporates a steering wheel 160 mounted on the hull 34 for pivotal movement. The operator can rotate the steering wheel 160.

A steering position command sensor 162 preferably is disposed around a shaft of the steering wheel 160 or at any other portions in connection with the steering wheel 160. Rotary potentiometers or encoders such as, for example, an optical encoder or a magnetic encoder can form the steering position command sensor 162. The steering position command sensor 162 senses an angle position of the steering wheel 160 relative to the hull 34 to generate a steering position command signal. The steering device 158 preferably has a steering control node 164 of the network system 32. Preferably, the remote controller 146 and the steering device 158 are disposed next to each other such that the operator can operate them simultaneously.

With continued reference to FIG. 1, a control panel unit 168 preferably extends in front of the steering device 158 on the hull 34. The control panel unit 168 has a panel unit node 169 of the network 32. The illustrated control panel unit 168 preferably includes at least a control panel 170, a switch key recess 172, a speedometer 174 and any other devices that are convenient for the operator. For example, a display such as a LCD (liquid crystal display) is assembled with the control panel unit 168. The control panel unit 168, and particularly the control panel 170, forms a control data input device in this embodiment. The control panel 170 preferably incorporates a mode selector 176 and a target speed input unit or data input unit 178.

The mode selector 176 preferably is a two-position switch by which the operator can select one of a constant speed mode and a manual control mode. One physical position of the switch can generate a constant speed mode signal that starts the constant speed mode. The other physical position can generate a manual control mode signal that starts the manual control mode. When the constant speed mode is selected, the throttle valve actuator 76 is controlled to set the throttle valve 74 to a certain open degree and the watercraft 30 thus proceeds at a substantially constant speed without a manual operation of the remote controller 146 by the operator. When the manual control mode is selected, the throttle valve actuator 76 is released from the fixed position. The operator thus can set the throttle valve 74 to any open degree by manually operating the remote controller 146 and the watercraft 30 proceeds in a speed corresponding to the open degree of the throttle valve 74.

In one variation, the mode selector 176 can have an appearance as a constant speed mode selection switch that has a closed or "ON" position and an open or "OFF" position. The constant speed mode is selected when the switch is in the closed or "ON" position. Also, the manual control mode is selected when the switch is in the open or "OFF" position.

In another variation, a one-position switch can replace the two-position switch. For example, the one-position switch preferably is a normally open push switch that has a switch circuit. A bias member urges a movable contact to an open position and the movable contact can contact a fixed contact when the operator pushes the movable contact against the bias force of the bias member. The switch circuit initially is reset to the manual control mode when a main switch or power switch is closed and generates a trigger signal that starts the constant speed mode when the operator pushes the movable contact. Afterwards, the switch circuit alternately changes the constant speed mode to the manual control mode and vice versa whenever the operator pushes the movable contact. Yet another option is to provide one or more "soft keys" or icons that may be touched on an LCD touchscreen to select or switch between the constant speed and manual control modes.

As thus described, the mode selector 176 can take various appearances, configurations and mechanisms. In the preferred embodiment, no existence of the constant speed mode signal means that a manual control mode signal exists because the constant speed mode and the manual control mode are selectively provided by the mode selector 176.

In order to provide a target speed of the watercraft 30, the operator can use the target speed input unit 178. The target speed input unit 178 preferably comprises a keyboard or any other input device through which the operator can input numbers corresponding to target speeds. The numbers corresponding to the target speeds can be data for generating target speed signals Vt. The input speed data can be indicated by, for example, the display. Preferably, multiple target speeds can be selectively set in accordance with riding skills or levels of various waterskiers or sport board riders such as beginner, intermediate, and advanced.

The switch key recess 172 preferably receives a switch key to operate a main switch unit that activates electrical components including the network system 32. The main switch unit preferably is formed with at least one main relay and other components including other relays. The electrical components are connected to an electric source such as, for example, one or more batteries when the operator inserts the switch key into the switch key recess 172 and rotates the switch key to turn the main switch unit on.

The speedometer 174 in this arrangement is an analog meter that can indicate an actual speed or velocity of the watercraft 30 sensed by a watercraft velocity sensor 182. Alternatively, a velocity display such as, for example, a LCD can replace the analog meter to indicate the speed of the watercraft 30 either in analog or digital representation.

Figure 2:
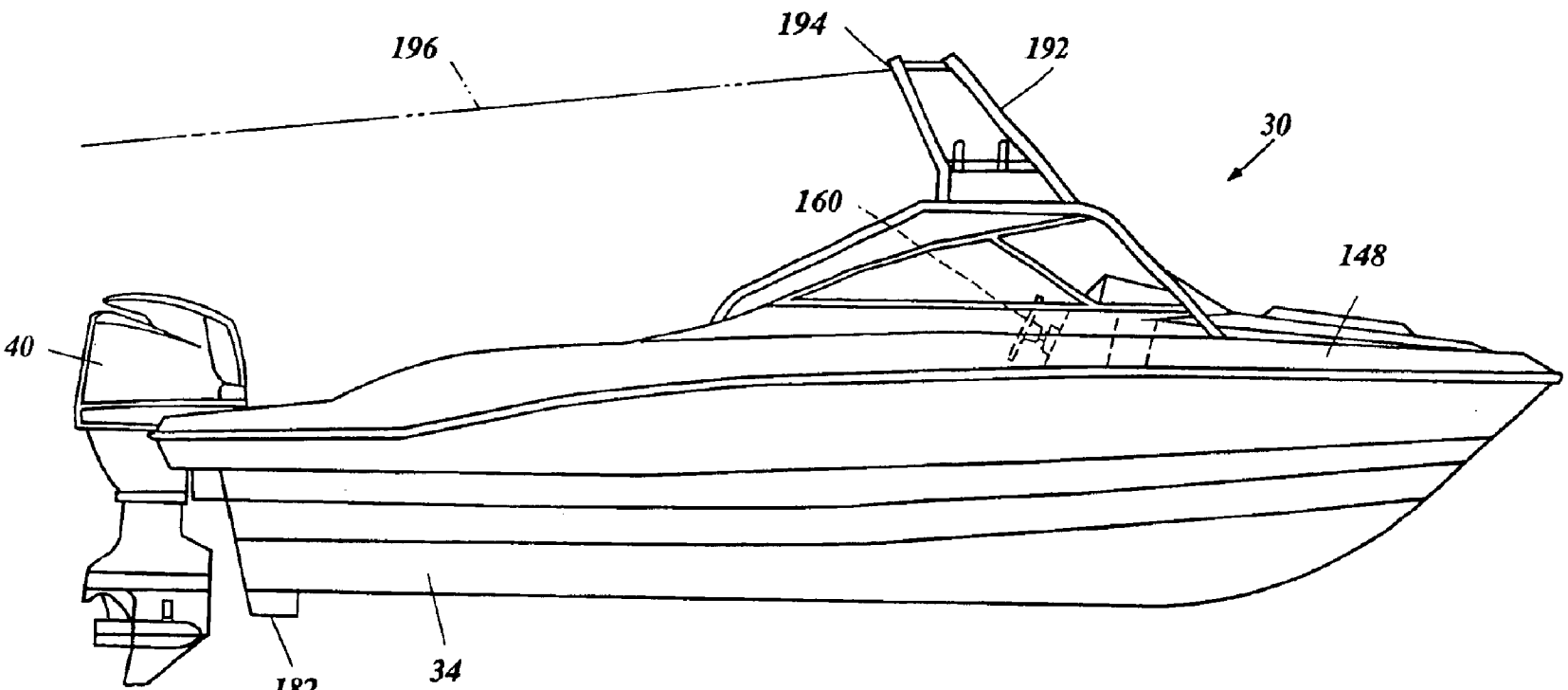
FIG. 2 illustrates a schematic representation of a side elevational view of the watercraft of FIG. 1.

With reference to FIGS. 1 and 2, the watercraft velocity sensor 182 preferably is mounted on an outer bottom of the hull 34 in the stern of the watercraft 30. The velocity sensor 182 preferably comprises an impeller type sensor to sense a rotational speed of the impeller that is rotated by the water that flows along the bottom of the hull 34. The rotational speed of the impeller generally is proportional to the speed of the watercraft 30. Alternatively, the velocity sensor 182 can incorporate a Pitot tube and senses a water pressure in the tube to detect the speed of the watercraft 30. In another variation, outputs of the GPS (groval positioning system) can be used to calculate the speed of the watercraft 30. The velocity sensor 182 has a velocity sensor node 184 of the network system 32.

The network system 32 in the illustrated embodiment is a controller area network (CAN) that is one type of a local area network (LAN). A bus or bus line 188 of the network system 32 connects the engine control node 96, the shift control node 144, the remote controller node 150, the steering control node 164, the panel unit node 169 and the velocity sensor node 184, all of which are terminal nodes of the network system 32. A network management node 190 also is connected to the bus 188 to manage the terminal nodes 96, 144, 150, 164, 169, 184.

The illustrated bus 188 preferably is formed with twisted pair cables. Each terminal node 96, 144, 150, 164, 169, 184 has a classification identifier or ID that specifies its type. Each terminal node 96, 144, 150, 164, 169, 184 creates a transfer frame or packet that has an ID field in which at least the classification identifier can be included and a data field in which a product or part number, a manufacturing number, a manufacturer number and other specific data can be included. Each terminal node 96, 144, 150, 164, 169, 184 transfers its frames onto the bus 188 according to certain timing to communicate with other terminal nodes and/or the management node 190. The management node 190 manages communication among these terminal nodes 96, 144, 150, 164, 169, 184. For communication purposes, the management node 190 assigns a physical address or network address to each terminal node 96, 144, 150, 164, 169, 184. A medium access method such as, for example, a carrier sense multiple access/collision detection (CSMA/CD) method preferably is used to access the bus 188.

The bus 188 can be connected to the nodes 96, 144, 150, 164, 169, 184, 190 in any form such as, for example, a ring form or a star form. The bus 188 can use any cables or wires other than the twisted pair cables such as, for example, Ethernet (CAT-5) or optical cables. Furthermore, a wireless type bus that has no cables or wires can replace the illustrated bus 188.

Such a network system is disclosed in, for example, a co-pending U.S. application filed Jul. 11, 2003, titled MULTIPLE NODE NETWORK AND COMMUNICATION METHOD WITHIN THE NETWORK, which Attorney's docket number is FS.20107US0A, the entire contents of which are hereby expressly incorporated by reference.

Because of the structure of the network 32, the engine control unit 94 and the shift control unit 142 can monitor and use all of the data that is transmitted on the network system 32 including the watercraft velocity data. For instance, the engine control unit 94 can monitor the shift rod angle position (or shift position) that is primarily sent to the shift control unit 142. On the other hand, the shift control unit 142 can monitor the throttle valve position THd that is primarily sent to the engine control unit 94. More generally, any node can monitor the transmissions of any other node.

With reference to FIG. 2, the watercraft 30 preferably has a tower or gate assembly 192 that stands from the deck 148 to generally extend over the cockpit. Preferably, the tower assembly 192 is generally formed as a gate shape and can be pulled down forwardly. The tower assembly 192 has a holding portion 194 generally at a center area thereof. A rope 196 can extend from the holding portion 194. Preferably, one end of the rope 196 is held at the holding portion 194. A wake boarder or a waterskier can grasp the other end of the rope to be pulled by the watercraft. Although the invention is useful for these and similar sports activities, the invention is not so limited.

Figure 4:
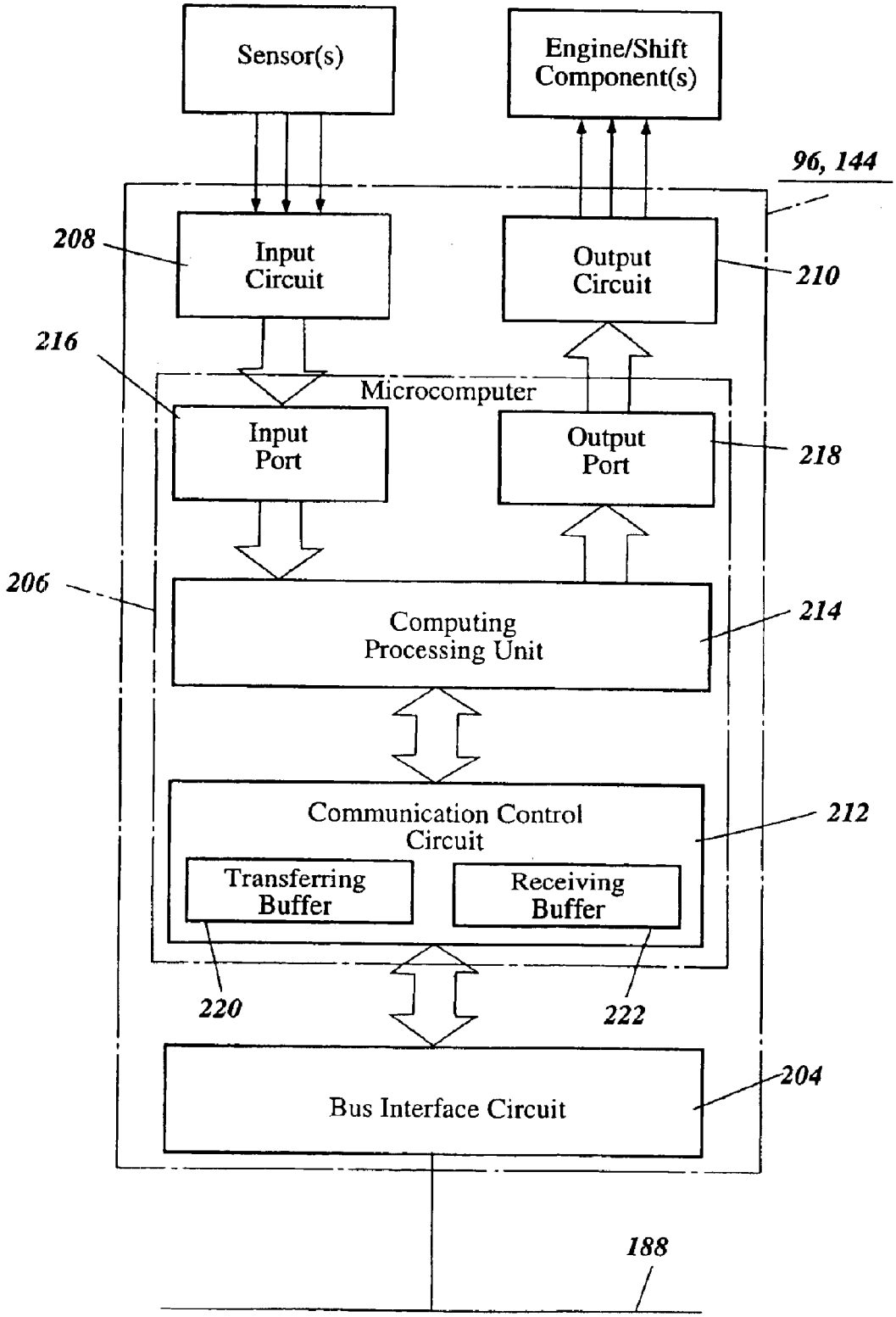
FIG. 4 illustrates a block diagram of a control node that may be either an engine control node associated with the engine and including the engine control unit or a shift control node associated with the transmission and including the shift control unit, wherein the engine control node and the shift control node are part of the network of FIG. 1.

With reference to FIG. 4, the engine control node 96 and the shift control node 144 have the same structure, and thus are represented by a common block diagram. Each comprises a bus interface circuit 204, a microcomputer 206, an input circuit 208 and an output circuit 210. The microcomputer 206 is a central processor of the engine control node 96 or the shift control node 144 and includes a communication control circuit 212, a computing processing unit 214, an input port 216 and an output port 218.

The microcomputer 206 of the engine control node 96 is preferably connected to at least the throttle valve position sensor 108, the crankshaft angle position sensor 110, the intake pressure sensor 122, the engine temperature sensor 124, the cylinder discrimination sensor 126 and the steering position sensor through the input circuit 208. The microcomputer 206 of the shift control node 144 is preferably connected to at least the shift rod angle position sensor through the input circuit 208. The input circuit 208 of the engine control node 96 receives sensed signals or data from those sensors 108, 110, 122, 124, 126, 162 and sends the data to the input port 216. The input circuit 208 of the shift control node 144 receives sensed signals or data from the sensor shift rod angle position sensor and sends the data to the input port 216.

The input port 216 of the engine control node 96 receives the actual throttle valve position data THd, the crankshaft angle position data, the actual steering position data and other sensed data from the input circuit 178 and passes those data to the engine control node's computing processing unit 214. The input port 216 of the shift control node 144 receives the actual shift rod angle position data and passes the data to the shift control node's computing processing unit 214.

The microcomputer 206 of the engine control node 96 is connected to the throttle valve actuator 76, the fuel injectors 92, the igniters 104 and the steering actuator through the output circuit 210. The microcomputer 206 of the shift control node 144 is connected to the shift rod actuator 148 through the output circuit 210. The output port 218 receives control data from the computing processing unit 214 and passes the data to the output circuit 210. The output circuit 210 then transfers the control data to the actuators.

The computing processing unit 214 communicates with the communication control circuit 212 that has a transferring buffer 220 and a receiving buffer 222. The communication control circuit 212 is connected to the bus 188 through the bus interface circuit 204.

The computing processing unit 214 includes at least one non-volatile storage component or memory such as, for example, a ROM or EPROM device. The non-volatile storage preferably stores the classification identifier or ID, the product or part number, the manufacturing number, the manufacturer number and other specific data, as well as executable code. The computing processing unit 214 also includes one or more volatile storage components such as, for example, RAM to store a network address that will be assigned from the management node 190.

The computing processing unit 214 of the engine control node 96 calculates the engine speed based upon the signal from the crankshaft angle position sensor 110. The computing processing unit 214 of the engine control node 96 also calculates a throttle valve position control amount THc, the injection timing and duration of the fuel injectors 92, and the ignition timing of the igniters 104. The engine control node 96 controls the throttle valve actuator 76, the fuel injectors 92 and the igniters 104 and the steering actuator in accordance with the calculated results.

In addition, the computing processing unit 214 of the engine control node 96 preferably creates transfer frames one by one, each including the classification identifier in the ID field and the throttle valve position control amount THc, the throttle valve position THd or the engine speed in the data field for the shift controls.

The computing processing unit 214 of the shift control node 144 controls the shift rod actuator 148 based upon the shift position and a shift position domain; the engine speed and the throttle valve position THd from the engine control node 96; and the throttle valve position command THr and the shift position command from the remote controller node 150. The shift position domain is determined based upon the shift position sensed by the shift rod angle position sensor.

In addition, the computing processing unit 214 of the shift control node 144 creates transfer frames one by one, each including the Classification identifier in the ID field and the shift position domain in the data field for the engine and shift controls.

The engine control node 96 and the shift control node 144 output the transfer frames to the bus 188 through their respective communication control circuits 212 and bus interface circuits 204.

The engine control unit 94 is substantially identical in structure to the engine control node 96 except for the bus interface circuit 204. Also, the shift control unit 142 is substantially identical in structure to the shift control node 144 except for the bus interface circuit 204.

Figure 5:
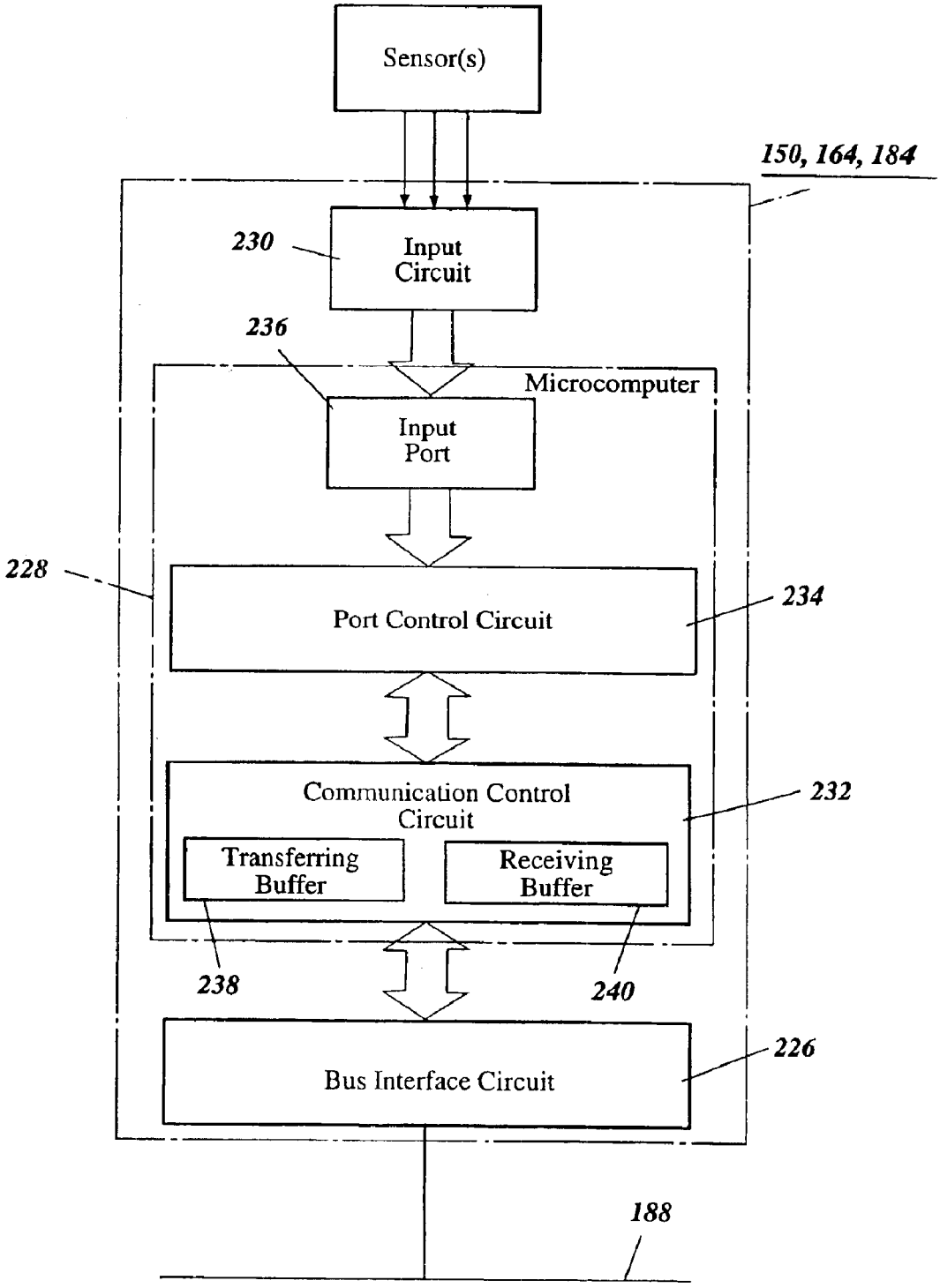
FIG. 5 illustrates a block diagram of a node that may be either a velocity sensor node, a remote controller node or a steering control node, all of which may be part of the network of FIG. 1.

With reference to FIG. 5, the remote controller node 150, the steering control node 164 and the velocity sensor node 184 each comprise a bus interface circuit 226, a microcomputer 228 and an input circuit 230. The microcomputer 228 is a central processor of those nodes 150, 164, 184 and includes a communication control circuit 232, a port control circuit 234 and an input port 236.

The microcomputer 228 of the remote controller node 150 is connected to the control lever angle position sensor 154 and receives an angle position signal of the control lever 152 through the input circuit 230. The microcomputer 228 of the steering control node 164 is connected to the steering position command sensor 162 and receives a steering position command signal from the steering position command sensor 162 through the input circuit 230. The microcomputer 228 of the velocity sensor node 1194 is connected to the velocity sensor 182 and receives a watercraft velocity signal from the velocity sensor 182 through the input circuit 230. The received data are sent to the input port 236, which passes the data to the port control circuit 234. The port control unit 234 communicates with the communication control circuit 232 that has a transferring buffer 238 and a receiving buffer 240. The communication control circuit 232 is connected to the bus 188 through the bus interface circuit 226.

The port control circuit 234 incorporates at least one non-volatile storage or memory component such as, for example, a ROM or EPROM device. The non-volatile storage preferably stores at least executable code, and a classification identifier or ID allotted to the remote controller node 150, the steering control node 164 or the velocity sensor node 184. The port control circuit 234 of the remote controller node 150 creates transfer frames one by one, each including at least the classification identifier in the ID field and the throttle valve position command THr and the shift position command in the data field. The port control circuit 234 of the steering control node 164 creates transfer frames one by one, each including at least the classification identifier in the ID field and the steering position command data in the data field. The port control circuit 234 of the velocity sensor node 184 creates transfer frames one by one, each including at least the classification identifier in the ID field and the watercraft velocity data in the data field.

The port control circuit 234 also incorporates one or more volatile storage components such as, for example, RAM to store the network address that will be assigned from the management node 190.

Figure 6:
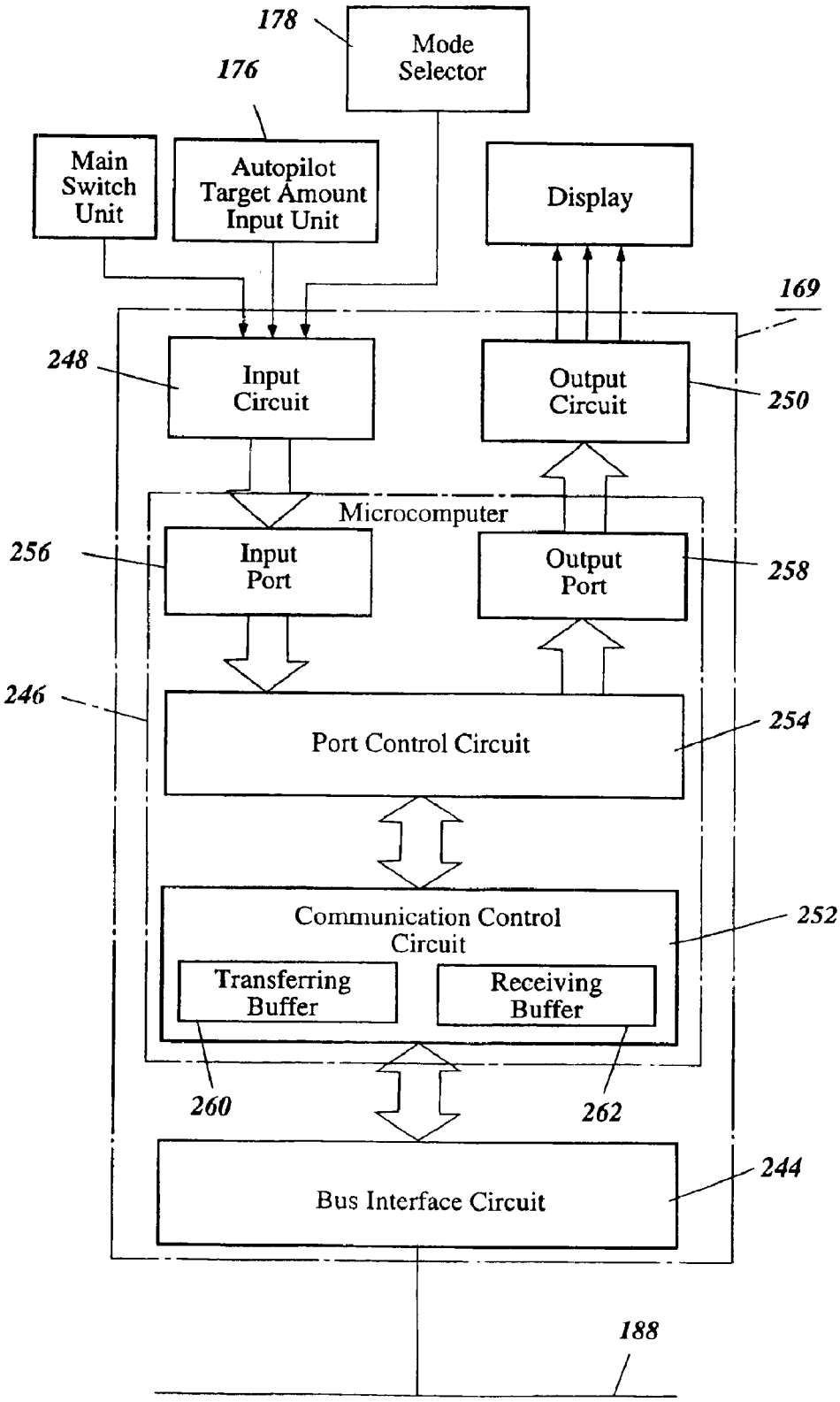
FIG. 6 illustrates a block diagram of a panel unit node which also is part of the network of FIG. 1.

With reference to FIG. 6, the panel unit node 169 comprises a bus interface circuit 244, a microcomputer 246, an input circuit 248 and an output circuit 250. The microcomputer 246 is a central processor of the panel unit node 169 and includes a communication control circuit 252, a port control circuit 254, an input port 256 and an output port 258.

The microcomputer 246 is connected through the input circuit 248 at least to the main switch unit that has the switch key recess 172, the mode selector 176 and the target speed input unit 178. The microcomputer 246 can be connected to other devices that have data that can be displayed on the display. For instance, the devices can include a compass or a residual fuel amount sensor, if any. The watercraft velocity sensor 182, for example, can be excluded because the watercraft velocity data is transferred to the panel unit node 169 through the bus 188. The input circuit 248 receives the main switch signal and the display data and sends the signal and data to the input port 256. The input port 256 receives the signal and data from the input circuit 248 and passes them to the port control circuit 254.

The microcomputer 246 also is connected to the speedometer 174, the display, and other meters, if any, through the output circuit 250. The output port 258 receives the display data from the port control circuit 254 and passes the data over to the output circuit 250. The output circuit 250 then transfers the display data to the speedometer 174, the display and/or other meters.

The port control circuit 254 communicates with the communication control circuit 252. The communication control circuit 252 has a transferring buffer 260 and a receiving buffer 262 and is connected to the bus 188 through the bus interface circuit 244.

The port control circuit 254 incorporates at least one non-volatile storage or memory component such as, for example, a ROM or EPROM device. The non-volatile storage preferably stores at least a classification identifier or ID allotted to the panel unit node 169. The port control circuit 254 creates at least one transfer frame including at least the classification identifier in the ID field. The port control circuit 254 also incorporates one or more volatile storage components such as, for example, RAM to store a network address that will be assigned from the management node 190.

Figure 7:
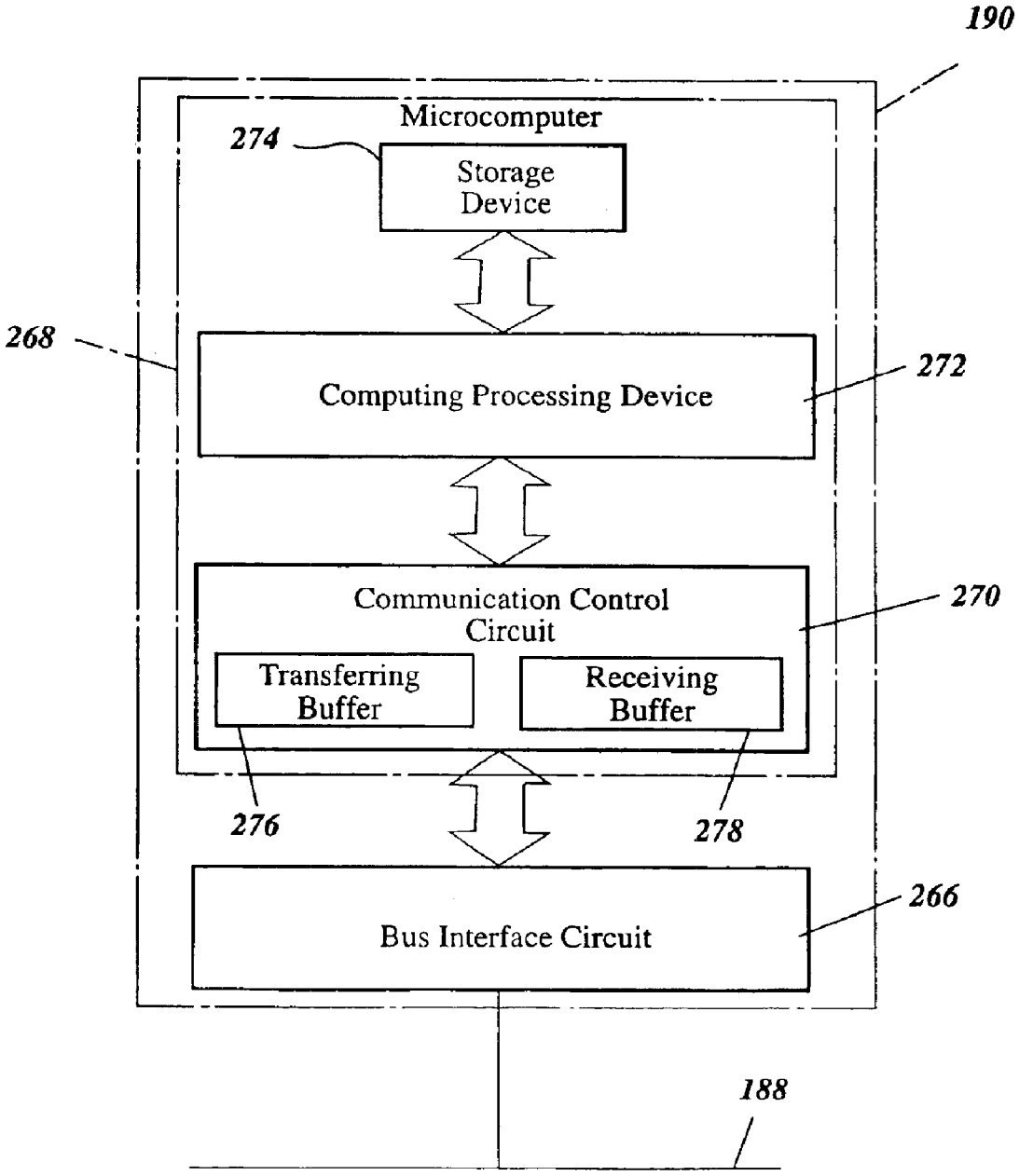
FIG. 7 illustrates a block diagram of a network management node which further is part of the network of FIG. 1.

With reference to FIG. 7, the network management node 190 comprises a bus interface circuit 266 and a microcomputer 268. The microcomputer 268 is a central processor of the management node 190 and includes a communication control circuit 270, a computing processing device 272 and a storage device 274.

The computing processing device 272 communicates with the communication control circuit 270. The communication control circuit 270 has a transferring buffer 276 and a receiving buffer 278 and is connected to the bus 188 through the bus interface circuit 266.

The computing processing device 272 also communicates with the storage device 274. The storage device 274 has at least one volatile storage component or memory such as, for example, RAM. The storage device 274 can also have non-volatile storage. The storage device 274 preferably stores a classification list indicating relationships between classifications and the classification identifiers, and a network address list indicating relationships between network addresses that will be assigned to the respective terminal nodes 96, 144, 150, 164, 169, 184, and the classification identifiers and the manufacturing numbers of those terminal nodes 96, 144, 150, 164, 169, 184.

Figure 8:
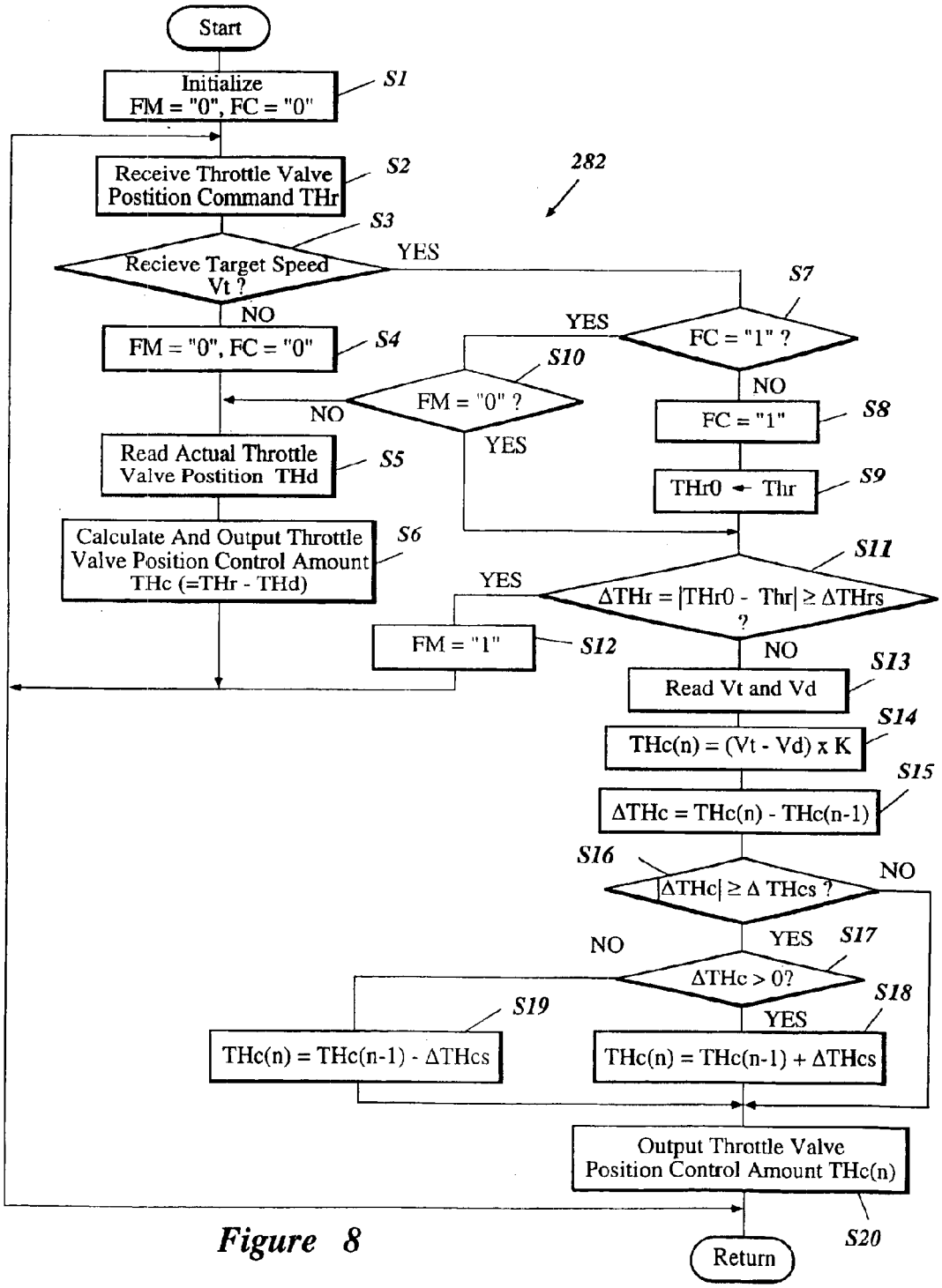
FIG. 8 illustrates a flow chart of an embodiment of a control program for a watercraft speed control process executed by the engine control node.

With reference to FIG. 8, the microcomputer 206 of the engine control node 96 executes a watercraft speed (or velocity) control process that provides the throttle valve position control amount THc with which the throttle valve actuator 76 is operated. The speed control process may be implemented within software executed by the engine control node 96. The speed control process in this embodiment is executed by a control program 282. The speed control process starts when the main relay of the main switch unit is activated and the electric power is supplied to the engine control node 96. The main relay is activated when the operator inserts the switch key into the switch key recess 172 and turns the key to a power supply position which is located before an engine start position.

Steps S7–S20 of FIG. 8 correspond to the constant speed mode. As will be apparent from the description below, these steps generally perform the following functions: (1) initiate a change to the manual control mode if the throttle valve position command THr has changed by at least a preset command threshold ΔTHr since the last iteration, and (2) if no such mode change is initiated, calculate and output a throttle valve position control amount THc that seeks to bring the watercraft to the target speed at a controlled rate or to maintain the watercraft at the target speed. Steps S4–S6 of FIG. 8 generally correspond to the manual control mode.

The engine control node 96, at a step S1, initializes flags that may have been previously set to "1." In the illustrated embodiment, the engine control node 96 resets both of a mode change flag FM and a constant speed state flag FC to "0." The mode change flag FM designates, if set to "1," that a mode change is being made as the result of operator movement of the control lever 152 to adjust the watercraft's speed. In the illustrated embodiment, the mode change flag FM substantially designates that a mode change is being made to the manual control mode from the constant speed mode. In other words, the mode change flag FM, when set to "1," cancels the constant speed mode and reinstates the manual control mode. The constant speed state flag FC designates, if set to "1," that the watercraft is in the constant speed mode. The program 282 goes to a step S2.

The engine control node 96, at the step S2, receives a transfer frame from the remote controller node 150. The engine control node 96 extracts a throttle valve position command THr from the data field of the transfer frame and stores the throttle valve position command THr in a throttle valve position command storage area of the storage of the computing processing unit 214. The program 282 then goes to a step S3.

At the step S3, the engine control node 96 determines whether a transfer frame that carries a target speed Vt in the data field has been received from the panel unit node 169. The target speed Vt can be entered through the target speed input unit 178. As discussed below with reference to FIG. 9, frames received from the panel unit mode 169 do not include target speed information when the mode selector is in the manual control mode position. If the determination is negative and the engine control node 96 has received another transfer frame that does not carry the target speed Vt, the program 282 goes to a step S4 because the operator has selected the manual control mode by the mode selector 176 as described below with reference to FIG. 9.

The engine control node 96, at the step S4, resets both of the mode change flag FM and the constant speed state flag FC to "0" just like the initialization of the flags FM, FC at the step S1. If the determination at the step S3 is first made after the initialization at the step S1, the flags FM, FC are already "0" prior to execution of this step S4. The program 282 then goes to a step S5.

At the step S5, the engine control node 96 receives an actual throttle valve position signal THd from the throttle valve position sensor 108 and stores the throttle valve position signal THd in an actual throttle valve position storage area of the storage of the computing processing unit 214. Then, the program 282 goes to a step S6.

The engine control node 96, at the step S6, calculates a throttle valve position control amount THc based upon the throttle valve position command THr stored at the step S2 and the actual throttle valve position THd stored at the step S5 using the following equation (1):

$$THc = THr - THd \quad (1)$$

The throttle valve position control amount THc is an angular amount that makes the actual throttle valve position THd coincide with the throttle valve position command THr. The engine control node 96 outputs the throttle valve position control amount THc to the throttle valve actuator 76. The program 282 returns back to the step S2.

On the other hand, if the determination at the step S3 is positive and the engine control node 96 has received the transfer frame that carries a target speed Vt, the program 282 branches to a step S7 because the operator has selected the constant speed mode. The engine control node 96, at the step S7, determines whether the constant speed state flag FC is set to "1."

If the determination at the step S7 is negative, the program 282 goes to a step S8 to set the constant speed state flag FC to "1." After setting the constant speed state flag FC to "1," the program 282 goes to a step S9. At the step S9, the engine control node 96 stores the current throttle valve position command THr as a throttle valve position command reference THr0 in a throttle valve position command reference storage area of the storage of the computing processing unit 214. The program 282 then goes to a step S11.

If the determination at the step S7 is positive, the program 282 branches to a step S10 to determine whether the mode change flag FM is reset to "0" meaning that no mode change is being made. If the determination at the step S10 is negative and the mode change flag FM is set to "1," the program 282 goes to the step S5 because the operator has initiated a change from the constant speed mode to the manual control mode as detected in a previous iteration of the program 282. The mode change flag FM can be set to "1" at a step S12 as the result of operator movement of the control lever 152 while in constant speed mode, as will be described shortly. If the determination at the step S110 is positive and the mode change flag FM is "0," the program 282 goes to the step S11 based on the assumption that the operator intends to keep the watercraft in the constant speed mode.

At the step S11, the engine control node 96 determines whether a throttle valve position command difference ΔTHr is equal to or greater than a preset command threshold ΔTHrs. The throttle valve position command difference ΔTHr is an absolute value of a difference between the throttle valve position command reference THr0 and the throttle valve position command THr. That is, the throttle valve position command difference ΔTHr can be calculated by the following equation (2):

$$\Delta THr=|THR0-THr| \tag{2}$$

Assuming that the program 282 reaches the step S11 through the step S9, the throttle valve position command reference THr0 is absolutely equal to the throttle valve position command THr and the throttle valve position command difference ΔTHr is "0." On the other hand, if the program 282 reaches the step S11 through the step S10, the throttle valve position command difference ΔTHr can be greater than or equal to "0" and also be greater or less than or equal to the preset command threshold ΔTHrs. This is because the throttle valve position command reference THr0 has been set in the last iteration of the program 282 and the current throttle valve position command THr is different from the throttle valve position command THr that was used to set the throttle valve position command reference THr0.

If the determination at the step S11 is positive and the throttle valve position command difference ΔTHr is equal to or greater than the preset command threshold ΔTHrs, the program 282 goes to a step S12 because the operator presumably intends to change from the constant speed mode to the manual control mode by operating the remote controller 146. The engine control node 96, at the step S12, therefore sets the mode change flag FM to "1" to indicate that a mode change is underway. The program 282 then returns back to the step S2.

If the determination at the step S11 is negative and the throttle valve position command difference ΔTHr is less than the preset command threshold ΔTHrs, the program 282 goes to a step S13 based on the assumption that the operator intends to keep the watercraft in the constant speed mode. This event may occur if the operator makes no adjustment or only a very small adjustment to the position of the control lever 152.

Because the determination at the step S11 can be positive only when the throttle valve position command difference ΔTHr is equal to or greater than the preset command threshold ΔTHrs, the intention of the operator is advantageously reflected in the determination.

At the step S13, the engine-control node 96 extracts a target speed Vt of the watercraft 30 from the data field of the transfer frame and stores the target speed Vt in a target speed storage area of the storage of the computing processing unit 214. Also, the engine control node 96 receives an actual speed signal Vd of the watercraft 30 from the velocity sensor 182 and stores the speed signal Vd in an actual speed storage area of the storage of the computing processing unit 214. The program 282 then goes to a step S14.

The engine control node 96, at the step S14, calculates a current throttle valve position control amount THc(n) based upon the target speed Vt and the current speed Vd using the following equation (3):

$$THc(n)=(THt-THd)\times K \tag{3}$$

The symbol "K" represents a change coefficient to change a speed difference (=THt−THd) to the throttle valve position control amount THc(n). The engine control node 96 stores the calculated throttle valve position control amount THc in a throttle valve position control amount storage area of the storage of the computing processing unit 214. The program 282 goes to a step S115.

At the step S15, the engine control node 96 calculates a throttle valve position control amount difference ΔTHc using a following equation (4):

$$\Delta THc=THc(n)-THc(n-1) \tag{4}$$

The symbol THc(n−1) represents the last throttle valve position control amount stored in the storage of the computing processing unit 214. Accordingly, the throttle valve position control amount difference ΔTHc is a change amount per unit time of the throttle valve position control amount THc.

The program 282 then goes to a step S16 to determine whether an absolute value of the throttle valve position control amount difference ΔTHc is equal to or greater than a preset control amount threshold ΔTHcs. The control amount threshold ΔTHcs preferably is predetermined at a proper throttle valve position that can generate a speed change rate (i.e., acceleration or deceleration) of the watercraft 30 with which the watercraft 30 can pull the sport board rider (e.g., wake border or waterskier) under a stable condition. If the determination at the step S16 is negative, program 282 goes to a step S20.

If the determination at the step S16 is positive, the program 282 goes to a step S17 to determine whether the throttle valve position control amount difference ΔTHc is greater than "0." In other words, the engine control node 96 determines whether the remote controller 146 is being operated to accelerate or decelerate the engine speed.

If the determination at the step S17 is positive and the remote controller 146 is being operated to accelerate the engine speed, the program goes to a step S18. At the step S18, the engine control node 96 calculates a current throttle valve position control amount THc(n) using the following equation (5):

$$THc(n)=THc(n-1)+\Delta THcs \quad (5)$$

The engine control node 96 stores the calculated current throttle valve position control amount THc(n) in the throttle valve position control amount storage area of the storage of the computing processing unit 214. The program 282 then goes to the step S20.

If the determination at the step S17 is negative and the remote controller 146 is being operated to decelerate the engine speed, the program goes to a step S19. At the step S19, the engine control node 96 calculates a current throttle valve position control amount THc(n) using the following equation (6):

$$THc(n)=THc(n-1)-\Delta THcs \quad (6)$$

The engine control node 96 stores the calculated current throttle valve position control amount THc(n) in the throttle valve position control amount storage area of the storage of the computing processing unit 214. The program 282 then goes to the step S20.

At the step S20, the engine control node 96 outputs the current throttle valve position control amount THc(n) stored either at the step S14, S18 or S19 to the throttle valve actuator 76. The program 282 returns back to the step S2.

Figure 9:
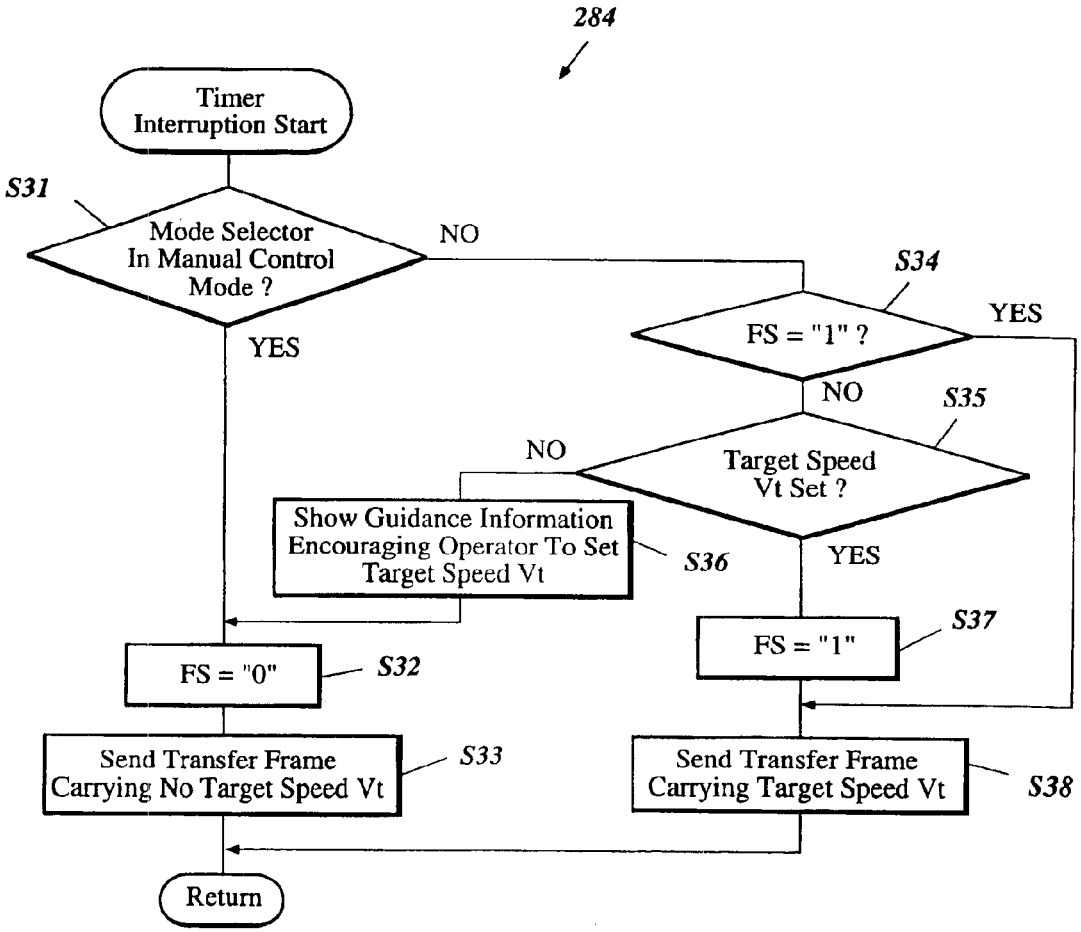
FIG. 9 illustrates a flow chart of an embodiment of a timer interruption program for a transfer frame creating and transferring process executed by the panel unit node.

With reference to FIG. 9, the microcomputer 206 of the panel unit node 169 executes a frame transferring control process to transfer a frame to the engine control node 96, which receives the frame at the step S3 of the program 282 of FIG. 8. The frame transferring process may be implemented within software executed by the panel unit node 169. The frame transferring process in this embodiment is executed by a timer interruption program 284. The panel unit node 169 preferably interrupts the control program 282 or other programs every preset time period (e.g., 50 msec) to execute the timer interruption program 284. The frame transferring control process starts when the main relay of the main switch unit is activated and the electric power is supplied to the panel unit node 169.

As described below, the program 284 of FIG. 9 generally operates by checking the state of the mode selector, and if set to the constant speed mode, making sure the operator has specified a target speed. The program also generates and transmits a frame to the engine control node. This frame specifies the target speed if both (1) the mode selector is in the constant speed position and (2) the operator has set the target speed; otherwise, no target speed information is included in the frame.

The panel unit node 169, at a step S31, determines whether the mode selector 176 is in the manual control mode position (or in the "OFF" position). If the determination is positive and the manual control mode is selected, the program 284 goes to a step S32.

At the step S32, the panel unit node 169 resets a constant speed selected flag FS to "0" because the manual control mode is selected. The constant speed selected flag FS designates, if set to "1," that the operator selects the constant speed mode by the mode selector 176. The program 284 then goes to a step S33. The panel unit node 169, at the step S33, creates a transfer frame that does not carry any target speed Vt in the data field and transfers the frame into the bus 188. The program 284 temporarily ends and returns control to the control program 282 or other programs.

On the other hand, if the determination at the step S31 is negative and the constant speed mode is selected, the program 284 branches to a step S34. At the step S34, the panel unit node 169 determines whether the constant speed selected flag FS is set to "1." If the determination at the step S34 is negative and the constant speed selected flag FS is reset to "0," the program 284 goes to a step S35 to determine whether the target speed Vt has been inputted through the target speed input unit 178.

If the determination at the step S35 is negative and the target speed Vt has not been entered yet, the program 284 goes to a step S36. The panel unit node 169, at the step S36, encourages the operator to input the target speed Vt. Preferably, the display is employed to show some guidance or messages that encourages the operator to input the target information through the target speed input unit 178. Alternatively or additionally, a buzzer can be used to call the operator's attention. The program 284 then goes to the step S32.

If the determination at the step S35 is positive and the target speed Vt has already been entered, the program 284 goes to a step S37. At the step S37, the panel unit node 169 sets the constant speed-selected flag FS to "1" because the mode selector is set to the constant speed mode. The program 284 then goes to a step S38.

The panel unit node 169, at the step S38, creates a transfer frame that carries the target speed Vt in the data field and transfers the frame onto the bus 188. The target speed Vt was entered or selected by the operator through the target speed input unit 178. The program 284 temporarily ends and returns control to the control program 282 or other programs.

If the determination at the step S34 is positive and the constant speed selected flag FS is set to "1," the program 284 jumps to the step S38.

With reference to FIGS. 8 and 9, an example of the operation watercraft speed control system is described below.

Initially, the watercraft 30 is standstill or berthed at a pier of a harbor or mooring place with the port side of the watercraft 30 facing the pier. No electric power is supplied to the respective nodes 96, 144, 150, 164, 169, 184, 190 and other electrical equipment of the watercraft 30 at this moment. The remote control lever 152 is set at the neutral position N. Under these conditions, the operator and the wake board rider(s), for example, get on board. The operator then inserts the switch key into the switch key recess 172 and turns the switch key to the power supply position. The respective nodes 96, 144, 150, 164, 169, 184, 190 and other electrical equipment thus are activated. The management node 190 assigns a physical address or network address to each of the terminal nodes 96, 144, 150, 164, 169, 184. Accordingly, the respective terminal nodes 96, 144, 150, 164, 169, 184 now can communicate with each other on the network 32 by transferring the transfer frames.

Because the remote control lever 152 is placed at the neutral position N, the throttle valve position command THr provided by the remote controller node 150 designates "0" that corresponds to the closed position of the throttle valves 74. Also, the shift position command designates the neutral position N. The remote controller node 150 creates a transfer frame that has the throttle valve position command THr and the shift position command in the data field and sends this transfer frame onto the bus 198.

In the initial state, the throttle valves 74 are maintained in the closed position because the throttle valve position control amount THc is "0." In this initial state, the mode selector 176 is in the physical position corresponding to the manual control mode. The target speed Vt has not been entered yet through the target speed input unit 178. The program 284 of FIG. 9 executes the steps S31, S32 and S33 when the program 284 runs. The panel unit node 169 thus creates a transfer frame that does not carry the target speed Vt in the data field and sends the transfer frame to the bus 188.

The engine control node 96 first initializes the mode change flag FM and the constant speed state flag FC at the step S1 of the control program 282 when the program 282 start running. That is, the engine control node 96 resets both the flags FM and FC to "0." The engine control node 96 receives the transfer frame from the remote controller node 150 at the step S2. The engine control node 96 extracts the throttle valve position command THr and stores the throttle valve position command THr in its storage.

The determination at the step S3 is negative because the target speed Vt is not contained in the data field of the transfer frame from the panel unit node 169. The engine control node 96 trys to reset the mode change flag FM and the constant speed state flag FC to "0" at the step S4; however, both of the flags FM and FC have already been reset at the step S1 in the initial execution. The engine control node 96 receives an actual throttle valve position signal THd from the throttle valve position sensor 108 and stores the actual throttle valve position signal THd in its storage at the step S5. The engine control node 96 also calculates the throttle valve position control amount THc using the equation (1) and based upon the throttle valve position command signal THr and the actual throttle valve position signal THd and outputs the throttle valve position control amount THc to the throttle valve actuator 76 at the step S6.

The throttle valve actuator 76 now can be activated with the throttle valve position control amount THc. In the initial state, however, the throttle valve position command signal THr is "0" assuming that the remote controller 146 is not yet operated. Accordingly, the throttle valve position control amount THc also is "0." The actuator 57 thus keeps its standstill state.

The operator, then, turns the switch key to the engine start position and the engine is started. Because the throttle valves 74 are placed in the substantially closed position, the engine operates at idle speed. Also, because the shift position command indicates the neutral position N, the shift control node 144 controls the shift rod actuator 148 to prevent the dog clutch unit from engaging either the forward or reverse bevel gear 132, 134. Thus, the engine output does not drive the propeller 124 and the watercraft 30 still maintains its standstill state.

The operator then operates the remote control lever 152 to the forward troll position F or to a certain position in the forward acceleration range GF through the forward troll position F from the neutral position N. The remote controller node 150 creates a transfer frame that carries a throttle valve position command THr corresponding to the forward troll position F or the position in the forward acceleration range GF and a shift position command designating the forward mode F and sends the transfer frame on the bus 188.

The shift control node 144 receives the transfer frame from the remote controller node 150 and controls the shift rod actuator 148 to have the clutch unit engage the forward bevel gear 132. The outboard motor 40 now operates in the forward mode F.

On the other hand, the engine control node 96 again calculates a throttle valve position control amount THc to make the actual throttle valve position THd coincide with the throttle valve position command THr at the step S6 using the equation (1). The engine control node 96 then controls the throttle valve actuator 76 with the throttle valve position control amount THc to have the throttle valves 74 open to a position corresponding to the throttle valve position command THr. The engine output thus is accelerated to an engine speed corresponding to the throttle valve position command THr. The watercraft 30 leaves the pier and proceeds forward with a speed corresponding to the engine speed accordingly.

When the watercraft 30 reaches a spot suitable for the wake board riding, the operator decelerates the engine speed and then stops the engine operation such that the watercraft 30 comes to a standstill there. The wake board rider enters the body of water and holds the rope 196 that extends from the tower assembly 92 of the watercraft 30 in the watercraft's standstill state. Then, the operator operates the remote controller 146 at the forward troll position F and the watercraft 30 gradually proceeds forwardly. The operator moves the remote control lever 152 back to the neutral position when the rope 196 is properly stretched. The operator sets a target speed Vt to a certain speed that is suitable for the skill of the wake board rider. For example, the target speed can be, for example, approximately 25 km/h. The operator then waits for a start signal from the board rider.

When the start signal is given by the wake board rider, the operator operates the remote control lever 152 within the forward acceleration range GF to accelerate the engine speed and starts towing the board rider. The steering device 158 is kept in a state such that the watercraft 30 proceeds straight. Under these conditions, the engine control node 96 still repeats the steps S2–S6 that correspond to the manual control m ode because the operator has not yet selected the constant speed mode by the mode selector 176.

With the acceleration of the engine speed, the, watercraft 30 accelerates. The board rider surfaces and starts riding. The operator then turns the mode selector 176 to the constant speed mode position (or to the "ON" position) while the board rider stably keeps the planing state. The determination at the step S31 executed by the panel unit node 169 thus becomes negative. The program 284 of FIG. 9 goes to the step S34. Because the constant speed selected flag FS is reset to "0" under the initial condition, the program 284 goes to the step S35. The program 284 then goes to the step S37 because the target speed Vt has been set. The panel unit node 169 sets the constant speed selected flag FS to "1" at the step S37. The panel unit node 169, at the step S38, creates a transfer frame carrying the target speed value Vt in the data field and sends the transfer frame to the bus 188.

The determination at the step S3 executed by the engine control node 96 now becomes positive and the program 282 of FIG. 8 goes to the step S7. Because the constant speed state flag FC is reset to "0", the program 282 goes to the step S8 to set the constant speed state flag FC to "1." The engine control node 96, at the step S9, stores the current position command signal THr as a position command reference THr0 in the storage thereof. The engine control node 96 then executes the step S11. Additionally, from the next execution after this first execution, the program 282 reaches the step S11 through the step S10 instead of the steps S8 and S9 because the constant speed state flag FC has been set to "1."

At the first execution of the step S11, the throttle valve position command reference THr0 is the same as the throttle valve position command signal THr. The throttle valve position command difference ΔTHr calculated by the equation (2) is of course less than the preset command threshold ΔTHrs. The throttle valve position command difference ΔTHr is still less than the preset command threshold ΔTHrs in the next execution of the step S10 because the operator has released the remote control lever 152. This situation continues until the operator operates the remote control lever 152 later. The program 282 goes to the step S12.

The engine control node 96 then extracts the target speed Vt from the transfer frame received at the step S13 and stores the target speed Vt in the storage of its own at the step S13. The engine control node 96 also stores an actual speed Vd of the watercraft 30 received from the throttle valve position sensor 108 in the storage thereof at the step S13. The program 282 then goes to the step S14.

The engine control node 96 calculates the current throttle valve position control amount THc(n) using the equation (3) at the step S14. Then, the engine control node 96 further calculates the throttle valve position control amount difference ΔTHc using the equation (4) at the step S15.

If the calculated throttle valve position control amount difference ΔTHc is less than the preset control amount threshold ΔTHcs, the determination at the step S16 is negative and the engine control node 96 provides the position control amount THc(n) calculated at the step S14 to the throttle valve actuator 76 at the step S20. If the calculated position control amount difference ΔTHc is greater than the preset control amount threshold ΔTHcs, the determination at the step S16 is positive and the engine control node 96 further determines whether the position control amount difference ΔTHc is greater than "0." If the determination at the step S17 is positive, the engine control node 96 calculates the current position control amount THc(n) using the equation (5) at the step S18 and provides the calculated current position control amount THc(n) to the throttle valve actuator 76 at the step S20. If, on the other hand, the determination at the step S17 is negative, the engine control node 96 calculates the current position control amount THc(n) using the equation (6) at the step S19 and provides the calculated current position control amount THc(n) to the throttle valve actuator 76 at the step S20.

The throttle valve actuator 76 thus turns the throttle valves 74 to the position corresponding to the current throttle valve position control amount THc(n) either at the step S14, S18 or S19. It should be noted that, in the illustrated embodiment, the watercraft speed does not reach the target speed Vt abruptly and the watercraft 30 gradually accelerates toward the target speed Vt. More specifically, if the throttle valve position control amount difference ΔTHc is less than the preset control amount threshold ΔTHcs, the actual throttle valve position THd catches up with the throttle valve position command THr. If the position control amount difference ΔTHc is greater than the preset control amount threshold ΔTHcs, the actual throttle valve position THd incrementally approaches the throttle valve position command THr by the amount of the preset control amount threshold ΔTHcs.

As thus described, in the illustrated embodiment, the throttle valve position control amount THc in every iteration is regulated by the control amount threshold ΔTHcs. Because of this regulated control amount THc and the moderate increment of the speed of the watercraft 30, the stability in towing the board rider or waterskier can be assured.

In the course of time, the engine 38 operates at an engine speed corresponding to the throttle valve position, and the actual speed Vd of the watercraft 30 reaches the target speed Vt. As a result, the throttle valve position control amount THc becomes almost "0." The throttle valve actuator 76 thus stops actuating the throttle valves 74. Afterwards, the engine control node 96 maintains the target speed Vt in the constant speed mode.

Under these conditions, if, for example, the board rider falls down to the body of water, the watercraft 30 should immediately go back to the rider. The operator thus eventually operates the remote control lever 152 to the neutral position N. The throttle valve position command THr becomes "0." The throttle valve position command difference ΔTHr becomes greater than the preset command threshold ΔTHrs. The determination at the step S11 of the program 282 thus becomes positive. The engine control node 96 sets the mode change flag FM to "1" at the step S12, accordingly.

In the next execution of the program 282; the determination at the step S3 is still positive because the mode selector 176 is set to the constant speed mode. The determination at the step S7 is positive because the constant speed state flag FC has been set to "1." The determination at the step S10 in turn becomes negative because the mode change flag FM has been set to "1" in the previous execution of the program 282. The engine control node 96 thus executes the steps S5 and S6 to provide the throttle valve position control amount THc calculated by the equation (1) to the throttle valve actuator 76. The throttle valve actuator 76 actuates the throttle valves 74 to have the actual throttle valve position THd coincide with the throttle valve position command THr. That is, the constant speed mode is automatically discontinued and the manual control mode resumed even though the mode selector 176 is still set to the constant speed mode.

The automatic change to the manual control mode from the constant speed mode is advantageous because the operator does not need to operate the mode selector 176. Particularly, the automatic mode change is quite advantageous if the watercraft 30 requires the operator a prompt change to the manual control mode.

The operator can move the remote control lever 152 to the reverse position R through the neutral position N to quickly stop the watercraft 30. The shift control node 144 controls the changeover mechanism 128 to engage the dog clutch unit with the reverse bevel gear 134 rather than the forward bevel gear 132 when the engine speed is lowered to idle. The throttle valve position THd also is set to a position corresponding to a throttle valve position command THr that is provided by the remote controller node 150 in response to the position of the remote control lever 152. The propeller 124 thus is in the reverse mode R and the watercraft 30 can stop immediately.

The operator then turns the steering wheel 160 and operates the remote control lever 152 to the forward position F or any position in the forward acceleration range GF to move the watercraft 30 toward the board rider.

Afterwards, the engine control node 96 keeps the manual control mode inasmuch as the constant speed state flag FC is set to "1" and the mode change flag FM is set to "1." If the operator wants to return to the constant speed mode, the operator turns the mode selector 176 to the manual control mode position once and then turns the mode selector 176 back to the constant speed mode position. With the first turn of the mode selector 176, the determination at the step S3 becomes negative because the panel unit node 169 executes the steps S31, S32 and S33. The engine control node 96 thus sets both of the constant speed state flag FC and the mode change flag FM to "0" at the step S4. Then, with the second turn of the mode selector 194 (to the constant speed mode position), only the constant speed state flag FC is newly set to "1" at the step S8 because the panel unit node 169 sends another transfer frame that has the target speed Vt at the step S38. The constant speed mode is resumed, accordingly.

Additionally, if the foregoing one-position switch is used, the operator can simply push the movable contact of the switch twice to return to the constant speed mode. If soft keys or icons on an LCD display are used, the operator may reinstate the constant speed mode by touching one or more such soft keys or icons.

The operator may want to release the constant speed mode when, for example, the board rider is deviating from a permitted area. The operator can operate the remote control lever 152 to release the constant speed mode as described above. If, however, the operator has enough time, the operator can operate the mode selector 176 rather than initiating the mode change via the remote control lever 152. By operating the mode selector 176 to the manual mode, the panel unit node 169 executes the steps S32 and S33. Because the panel unit node 169 sends a transfer frame that does not contain any target speed data Vt at the step S33, the engine control node 96 traces the steps S4–S6. The throttle valve actuator 76 thus moves the throttle valves 74 in response to the throtttle valve position command THr in the manual mode.

As will be recognized, a transition from the constant speed mode to the manual control mode will also occur if the operator merely adjusts the control lever 152 in a direction to slow down the watercraft, without shifting to the neutral position. This scenario may occur, for example, if the operator attempts to slow down the watercraft to circle back to the fallen rider.

The constant speed mode can be used in situations other than in towing a board rider or waterskier. For instance, the operator can set the constant speed mode while the watercraft 30 cruising on the open sea. Assuming that the operator has not moved the remote control lever 152 in the constant speed mode and maintains the constant speed mode through the entire cruise of the watercraft 30, the operator turns the mode selector 176 to the manual control mode position when the watercraft 30 returns to the harbor where the watercraft 30 has departed or reaches another harbor. In this situation, the determination at the step S3 becomes negative because the panel unit node 169 executes the steps S31, S32 and S33. The engine control node 96 thus resets both of the constant speed state flag FC and the mode change flag FM to "0" at the step S4. That is, the manual control mode re-starts.

Figure 10:
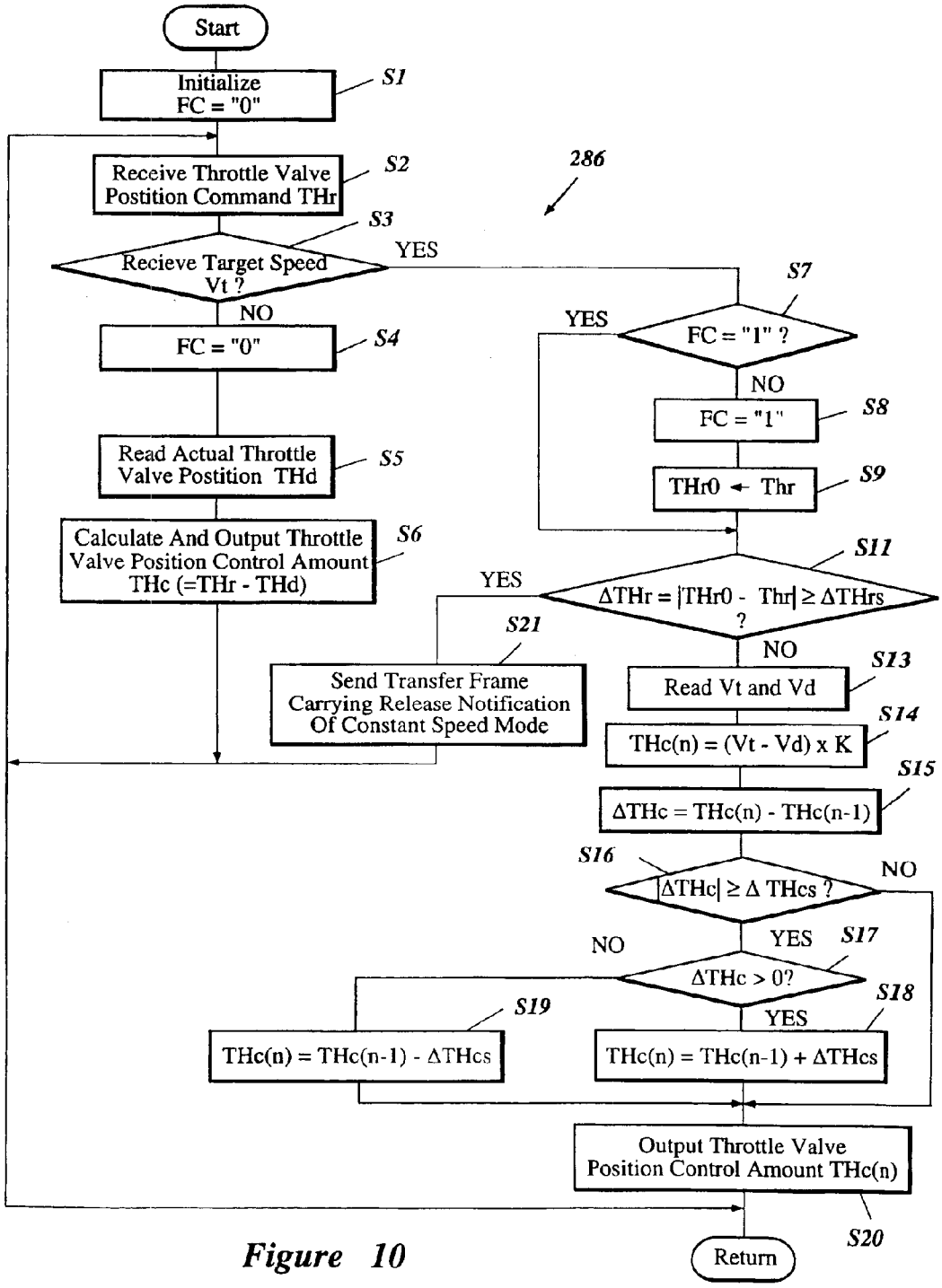
FIG. 10 illustrates a flow chart of another embodiment of the control program modified from the embodiment of FIG. 8.
Figure 11:
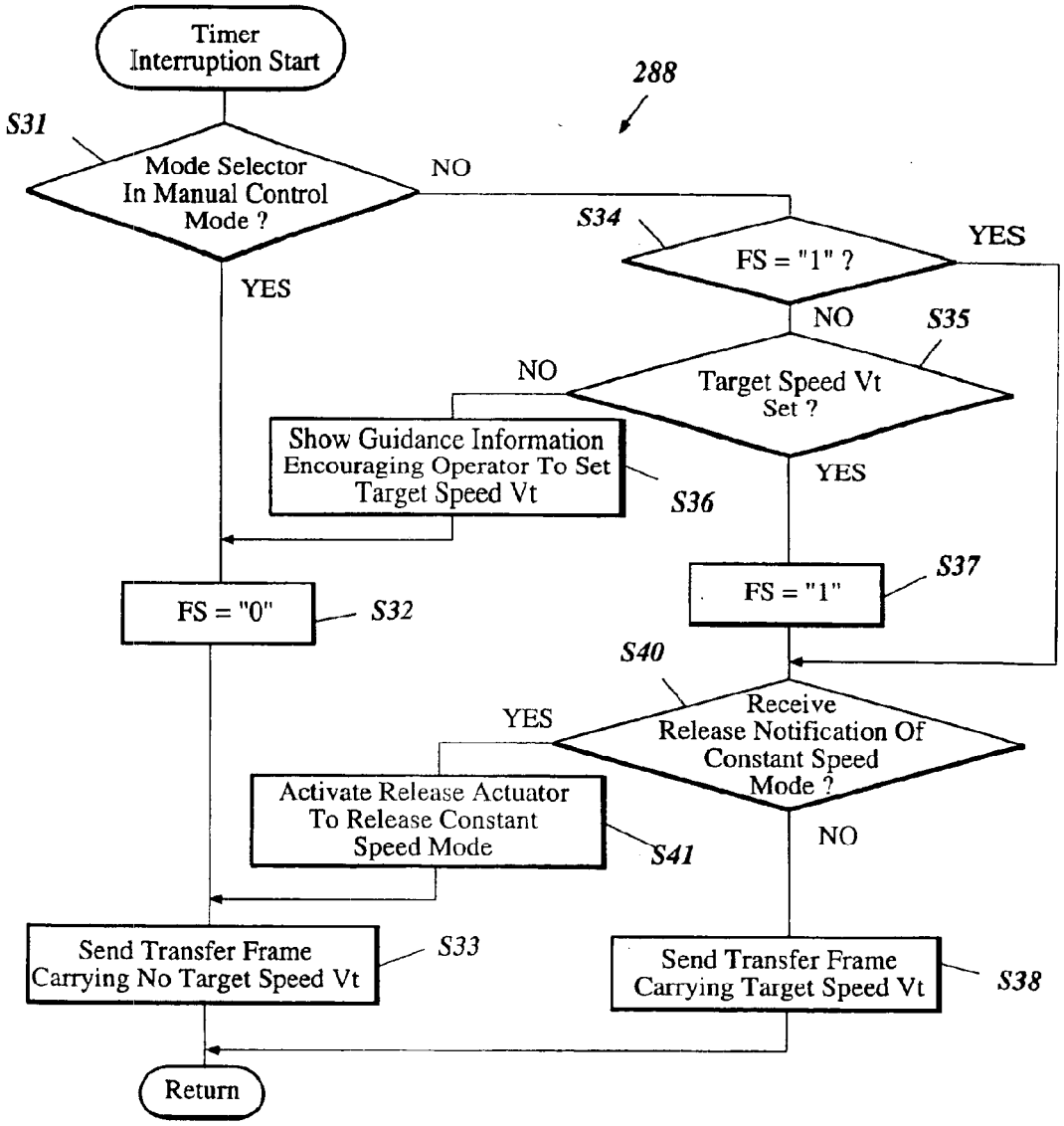
FIG. 11 illustrates a flow chart of another embodiment of the timer interruption program modified from the embodiment of FIG. 9 in relation to the program of FIG. 10.

With reference to FIGS. 10 and 11, a modified embodiment is described below. The same devices, components, members, amounts and steps described above are assigned with the same reference numerals or marks and will not be described repeatedly.

In this modified embodiment, the mode selector 176 is automatically and mechanically returned to the manual control mode position when a transition from the constant speed mode to the manual control mode occurs as the result of movement of the control lever 152. For example, a self-lock type push switch preferably replaces the two-position switch of the first embodiment. A release actuator (not shown) is provided to release the switch to the manual control mode position from the constant speed mode position. The release actuator in this embodiment comprises an electromagnetic solenoid. The push switch can be mechanically locked in the constant speed mode position when the operator pushes the switch. The release actuator coercively releases the switch from the locked position to the manual control mode position corresponding to an unlocked position when the panel unit node 169 controls the actuator to release the switch.

The modified embodiment is embodied within a control program 286 of FIG. 10 and a timer interruption program 288 of FIG. 11. In the program 286, the step S10 of the program 282 of FIG. 8 is omitted. The step S4 of the program 282 is modified to omit setting of the mode change flag FM and merely to set the constant speed state flag FC to "0." Also, a step S21 replaces the step S12 of the program 282 to create a transfer frame carrying a release notification of the constant speed mode that indicates that an constant speed mode is released and the manual control mode is reinstated.

In the program 288, steps S40 and S41 are added to execute the release of the push switch after the determination at the step S34. The panel unit node 169, at the step S40, determines whether the release notification of the constant speed mode has been received. If the determination is positive, the program 288 goes to the step S41 to activate the release actuator that releases the push switch. The program 288 then goes to the step S33. If the determination at the step S40 is negative and the release notification of the constant speed mode has not been received, the program 288 goes to the step S38.

The operator operates the remote control lever 152 to cause a transition from the constant speed mode to the manual control mode if, for example, the board rider falls down to the body of water. The throttle valve position command difference ΔTHr becomes equal to or greater than the preset command threshold ΔTHrs as the result of movement of the control lever 152. Thus, the determination at the step S11 becomes positive and the program 286 goes to the step S21. The engine control node 96, at the step S21, creates the transfer frame carrying the release notification of the constant speed mode and sends the transfer frame to the bus 188. The program 286 then returns back to the step S2.

On the other hand, the determination at the step S31 is negative because the mode selector 176, which now comprises the lock-type push switch, is locked in the constant speed mode position. The determination at the step S34 is positive because the constant speed selected flag FS is set to "1." Accordingly, the panel unit node 169, at the step S40, determines whether the release notification of the constant speed mode has been received. The determination at the step S40 is positive. The panel unit node 169 activates the release actuator to release the push switch from the locked position, i.e., the constant speed mode position to the manual control mode position. The panel unit node 169 then executes the step S33 and temporarily ends. The panel unit node 169 returns to the control of the primary control program.

As a result, the engine control node 96 reinstates the manual control mode because the determination at the step S3 is negative and executes the steps S4–S6 and returns to the step S2.

Assuming that the watercraft 30 does not tow any board rider and the operator maintains the constant speed mode and does not change from the constant speed mode to the manual control mode by operating the remote control lever 152 in the entire cruise and returns to the harbor where the watercraft 30 has departed or reaches another harbor, the operator theoretically needs to push the mode selector switch to release itself to the manual control mode position. Most likely, however, the operator will operate the remote control lever 152 to adjust the watercraft's speed or to change the mode of the propeller 124 so as to moor the watercraft 30 in a desired place. Further, the operator almost surely will move the remote control lever 152 to the neutral position N to remain the watercraft 30 standstill at the mooring place. Thus, in almost all the situations, the operator does not need to push the mode selector switch to release it to the manual control mode position because the switch automatically returns to the manual control mode position by at least one of the foregoing operations.

Even if the operator does not operate the remote control lever 152 in placing the watercraft 30 to the desired position and the watercraft starts proceeding without the switch changed to the manual control mode position, the switch inevitably and automatically returns to the manual control mode position whenever the operator operates the remote control lever 152 at a very early moment in the next departure.

Figure 12:
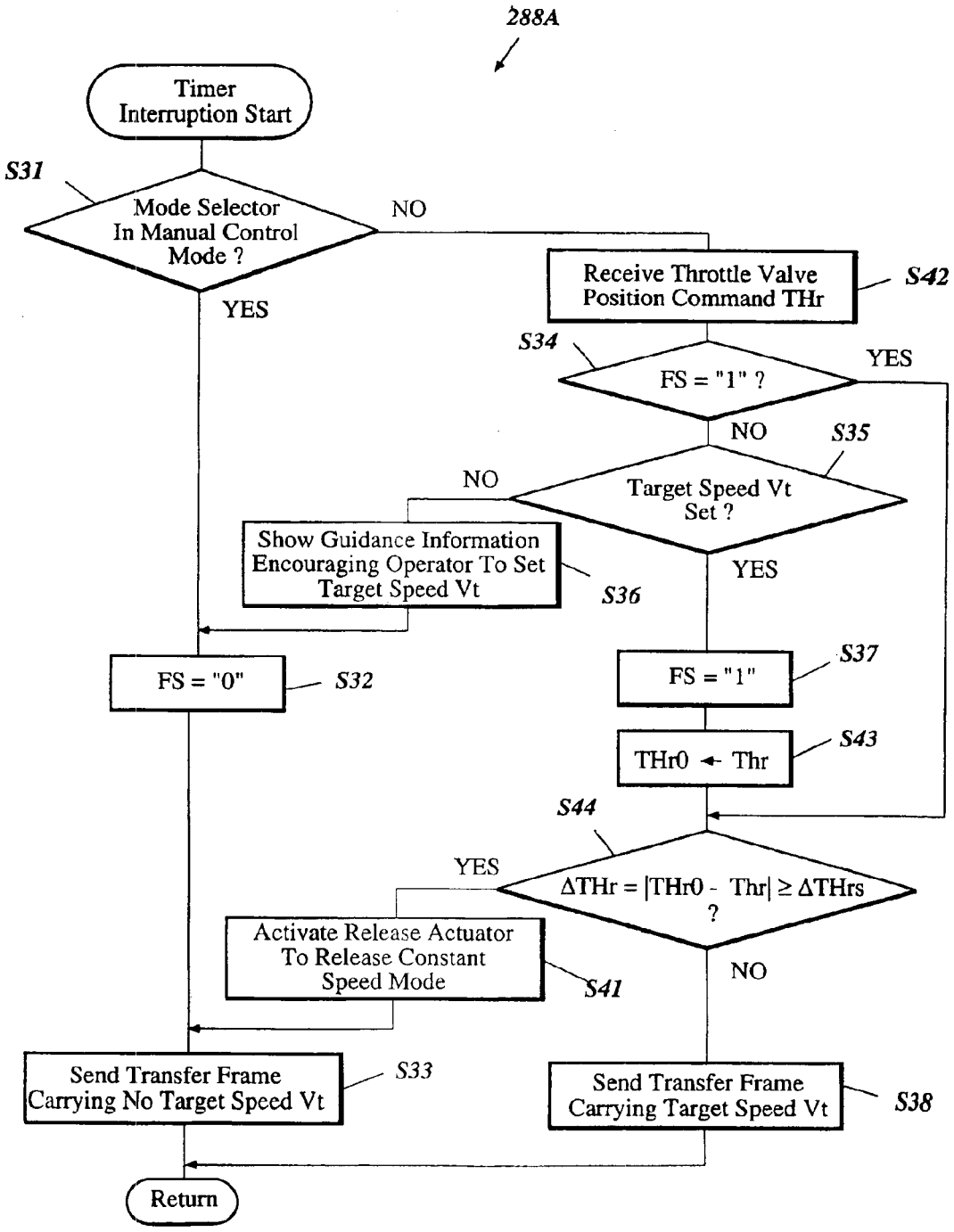
FIG. 12 illustrates a flow chart of a variation of the modified embodiment of FIG. 11.

With reference to FIG. 12, the panel unit node 169 can determine, instead of the engine control node 96, whether the mode should be changed from the constant speed mode to the manual control mode. A timer interruption program 288A, which is a variation of the program 288 of FIG. 11, can perform the determination.

In the alternative program 288A, the step S2 of the program 282 of FIG. 8 is added as a step S42 between the step S31 and the step S34 of the program 288 of FIG. 11. Also, the step S9 of the program 282 is added as a step S43 after the step S37 of the program 288. Further, the step S11 of the program 282 as a step 44 replaces the step S40 of the program 2-88. Accordingly, the program 282 starts at the step S1 and moves to the step S3 without executing the step S2 because the step S2 is moved to the program 288A. After the step S8 or the step S10, the program 282 goes to the step S13 because the steps S9 and S11 move to the program 288A. The alternative program 288A together with the program 282 that is changed as above can execute substantially the same operation as the program 288 of FIG. 11 and the program 286 of FIG. 8.

In a similar manner, steps of one program can be moved to another program. For example, the panel unit node 169 can transfer a transfer frame carrying the constant speed selected flag FS and the target speed Vt to the engine control node 96, and the engine control node 96 can control the throttle valve position based upon the constant speed selected flag FS and the target speed Vt. Further, as mentioned above, all of the computer implemented steps described herein could alternatively be performed by a single, centralized processor.

The target speed input unit 178 can be designed to maintain the data of the target speed Vt after the power is turned off. Preferably, however, the data can be deleted when the power is off to avoid an unintentional use of the previous data.

Any conventional switches can be used as the mode selector 176. The conventional switches can include mechanical switches and hybrid switches that comprise mechanical switch elements and electrical circuit elements.

The engine 38 can be based on a variety of operation principles. For example, a two-cycle engine can replace the four-cycle engine. Further, two or more engines may be included on the watercraft each of which operates as described herein.

The shift control unit or node can be omitted and the engine control unit or node, i.e., a single control unit or node, can control the engine, the changeover mechanism and other components, units or devices which are disposed on the outboard motor side.

The changeover mechanism 128 can be mechanically controlled. For example, the shift rod actuator 140 can be omitted and a mechanical cable movable along with the movement of the remote controller lever 152 can actuate the shift rod 136.

A single preset command threshold ΔTHrs is described with the foregoing embodiments. However, multiple preset command thresholds can be prepared to adapt to various board riders who have different levels of skill for the board riding. For instance, a threshold selector or control amount threshold setting device can be used to selectively set a suitable command threshold to an individual rider. A threshold selector node, for example, creates a transfer frame carrying a specific command threshold set by the threshold selector and sends the transfer frame to, for example, the engine control node. The engine control node controls the engine output based upon the command threshold. Such a threshold selector can not only provide a suitable command threshold to the individual rider but also reduce or eliminate the need for the operator to explicitly set the suitable command threshold.

The network system using the LAN (including CAN) is useful to realize the rapid, smooth and precise communications and controls and also is useful to simplify wiring. However, the respective terminal nodes can be connected with each other by any communication measures. For example, electric wire harnesses can be used. In this variation, the respective nodes can exchange data by electrical signals without transferring frames. Further, the various signals and commands can be transferred wirelessly such as by RF communications.

The current throttle valve position control amount THc(n) can be calculated or created by various methods other than using the equation (3). For instance, a fuzzy control module can be used to create the current throttle valve position control amount THc(n). Various factors such as, for example, an engine speed, a watercraft speed, a change rate of the engine speed or the watercraft speed (either acceleration or deceleration), a steering position and a throttle valve position can be inputted into the fuzzy control module. Using the fuzzy control module can contribute to realize various types of optimum control of the watercraft speed that adapt to various situations including, for example, a change of state of the watercraft, disturbance or user's taste. An exemplary fuzzy control module is disclosed in JP 2001-152898.

There are various ways to sense an actual speed of a watercraft other than the watercraft velocity sensor 182 that directly senses a speed of the watercraft. For instance, an observoir (or state estimating device) can be used. The observoir indirectly estimates a speed of a watercraft by force and angular momentum both exerted to a hull, and a motion model of the hull that includes a position, a speed, the force and the angular momentum as internal variables and that is described by a nonlinear type kinetic equation. An exemplary observer is disclosed in JP 2001-265406.

Although this invention has been disclosed in the context of a certain preferred embodiments and examples, it will be understood by those skilled in the art that the present invention extends beyond the specifically disclosed embodiments to other alternative embodiments and/or uses of the invention and obvious modifications and equivalents thereof. In addition, while several variations have been shown and described, other modifications, which are within the scope of this invention, will be readily apparent to those of skill in the art based upon this disclosure. It is also contemplated that various combinations or subcombinations of the specific features and aspects of the embodiments or variations may be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A watercraft comprising a propulsion device arranged to propel the watercraft, a prime mover that powers the propulsion device, a regulating device that regulates an output of the prime mover, the watercraft capable of proceeding generally at a speed corresponding to the output of the prime mover, a command input device configured to provide a command signal to control the regulating device, a speed sensing device configured to sense an actual speed of the watercraft and to provide an actual speed signal, a control device configured to control the regulating device, a control data input device configured to selectively provide the control device with a first mode signal that starts a first mode of the control device and a second mode signal that starts a second mode of the control device, the first mode being a manual control mode in which a human operator manually controls a speed of the watercraft, and the second mode being a mode in which the speed is controlled automatically, the second mode signal accompanied by a target speed signal indicative of a target speed of the watercraft, the control device controlling the regulating device based upon the command signal in the first mode, the control device controlling the regulating device in the second mode such that an actual speed of the watercraft designated by the actual speed signal generally corresponds with the target speed of the watercraft designated by the target speed signal, and the control device starting the first mode in place of the second mode without the first mode signal if the command signal changes while the control device controls the regulating device in the second mode.

2. The watercraft as set forth in claim 1, wherein the control device starts the first mode in place of the second mode when the command signal changes over a preset magnitude.

3. The watercraft as set forth in claim 1, wherein the control device starts the first mode in place of the second mode when a difference between a command amount designated by the command signal and a command reference amount is equal to or greater than a preset magnitude.

4. The watercraft as set forth in claim 3, wherein the command reference amount is another command amount that is designated by another command signal that has been previously provided.

5. The watercraft as set forth in claim 1, wherein the control device holds the first mode when the control device changes the second mode to the first mode without the first mode signal.

6. The watercraft as set forth in claim 1, wherein the second mode signal is canceled afterwards when the control device changes the second mode to the first mode without the first mode signal.

7. The watercraft as set forth in claim 1, wherein the control data input device comprises a mode selector through which the first and second mode signals are selectively provided to the control device.

8. The watercraft as set forth in claim 7, wherein the control data input device additionally comprises a data input unit, the target speed signal is inputted by the data input unit.

9. The watercraft as set forth in claim 7, wherein the control data input device automatically returns the mode selector to a position in which the mode selector provides the first mode signal.

10. The watercraft as set forth in claim 9 additionally comprising a switch actuator, the mode selector including a switch movable between a first mode position corresponding to the first mode and a second mode position corresponding to the second mode, the switch actuator coercively returning the switch to the first mode position.

11. The watercraft as set forth in claim 1, wherein the control device controls the regulating device such that the actual speed of the watercraft gradually approaches the target speed of the watercraft.

12. The watercraft as set forth in claim 1 additionally comprising a network system that has multiple nodes communicating with each other, the network system at least including a first node for the command input device, a second node for the speed sensing device, a third node for the control device, and a fourth node for the control data input device.

13. The watercraft as set forth in claim 1, wherein the prime mover is an engine, and the regulating device comprises a throttle valve unit that regulates an amount of air to the engine, the control device controls a position of the throttle valve unit.

14. A watercraft comprising a propulsion device arranged to propel the watercraft, a prime mover that powers the propulsion device, a regulating device that regulates an output of the prime mover, the watercraft capable of proceeding generally at a speed corresponding to the output of the prime mover, a command input device configured to provide a command signal to control the regulating device, a speed sensing device configured to sense an actual speed of the watercraft to provide an actual speed signal, a control device configured to control the regulating device, a control data input device configured to selectively provide the control device with a first mode signal that starts a first mode of the control device and a second mode signal that starts a second mode of the control device, the second mode signal associated with by a target speed signal indicative of a target speed of the watercraft, the control device controlling the regulating device based upon the command signal in the first mode, the control device controlling the regulating device in the second mode such that an actual speed of the watercraft designated by the actual speed signal generally corresponds with a target speed of the watercraft designated by the target speed signal, and the control device controlling the regulating device based upon the command signal if the command signal changes while the control device controls the regulating device in the second mode.

15. A watercraft comprising a propulsion device arranged to propel the watercraft, an engine that powers the propulsion device, an air intake device arranged to deliver air to the engine, a throttle valve unit that regulates an amount of the air, an output of the engine generally varying in response to the amount of the air, the watercraft capable of proceeding generally at a speed corresponding to the output of the engine, a command input device configured to provide a command signal indicative of a position of the throttle valve unit, a speed sensing device configured to sense an actual speed of the watercraft and to provide an actual speed signal, a control device configured to control the throttle valve unit, a control data input device configured to selectively provide the control device with a first mode signal that starts a first mode of the control device and a second mode signal that starts a second mode of the control device, the second mode signal associated with by a target speed signal indicative of a target speed of the watercraft, the control device controlling the throttle valve unit based upon the command signal in the first mode, the control device controlling the throttle valve unit in the second mode such that an actual speed of the watercraft designated by the actual speed signal generally corresponds with the target speed of the watercraft designated by the target speed signal, and the control device starting the first mode in place of the second mode without the first mode signal if the command signal changes while the control device controls the throttle valve unit in the second mode.

16. The watercraft as set forth in claim 15, wherein the control device controls the position of the throttle valve unit using a position control amount calculated based upon the actual speed of the watercraft and the target speed of the watercraft in the second mode.

17. The watercraft as set forth in claim 16, wherein the control device determines whether a difference between the position control amount and another position control amount that has been calculated previously is greater than a preset control amount threshold, the control device controls the throttle valve unit using the position control amount if the position control amount is equal to or less than the preset control amount threshold or another position control amount that does not exceed the preset position control amount threshold if the position control amount is greater than the preset control amount threshold.

18. The watercraft as set forth in claim 16 additionally comprising a control amount threshold setting device configured to set a plurality of the preset control amount thresholds.

19. The watercraft as set forth in claim 15 additionally comprising a position sensing device configured to sense an actual position of the throttle valve unit, the control device controlling the position of the throttle valve unit using a position control amount calculated based upon the command signal provided by the command input device and the actual position sensed by the position sensing device in the first mode.

20. The watercraft as set forth in claim 15, wherein the throttle valve unit comprises a throttle valve and a throttle valve actuator arranged to actuate the throttle valve.

21. A velocity control system for a watercraft comprising a command input device configured to provide a command signal to control a regulating device that regulates an output of a prime mover of the watercraft, a speed sensing device configured to sense an actual speed of the watercraft to provide an actual speed signal, a control device configured to control the regulating device, a control data input device configured to selectively provide the control device with a first mode signal that starts a first mode of the control device and a second mode signal that starts a second mode of the control device, the second mode signal accompanied by a target speed signal indicative of a target speed of the watercraft, the control device controlling the regulating device based upon the command signal in the first mode, the control device controlling the regulating device in the second mode such that an actual speed of the watercraft designated by the actual speed signal generally corresponds to the target speed of the watercraft designated by the target speed signal, and the control device starting the first mode in place of the second mode without the first mode signal if the command signal changes while the control device controls the regulating device in the second mode.

22. A computer-implemented control method for controlling a speed of a watercraft comprising regulating an output of a prime mover that powers a propulsion device of the watercraft, generating a command signal, sensing an actual speed of the watercraft to generate an actual speed signal, generating a first mode signal that starts a first mode, generating a second mode signal that starts a second mode, generating a target speed signal indicative of a target speed of the watercraft, controlling the regulation of the output of the prime mover based upon the command signal in the first mode, controlling the regulation of the output of the prime mover in the second mode such that an actual speed designated by the actual speed signal generally coincides with a target speed designated by the target speed signal, determining whether the command signal changes while controlling the regulation of the output of the prime mover in the second mode, and starting the first mode in place of the second mode without the first mode signal if the determination is positive.

23. The control method as set forth in claim 22 additionally comprising comparing a difference between a command amount designated by the command signal and a command reference amount with a preset magnitude, the first mode started if the difference is equal to or greater than the preset magnitude in addition to that the determination is positive.

24. The control method as set forth in claim 22 additionally comprising holding the first mode when the first mode is started without the first mode signal.

25. The control method as set forth in claim 22 additionally comprising canceling the second mode signal afterwards when the first mode is started without the first mode signal.

26. The control method as set forth in claim 22 additionally comprising controlling the regulation of the output of the prime mover such that the actual speed of the watercraft gradually approaches the target speed of the watercraft.

27. The control method as set forth in claim 22, wherein the prime mover is an engine, additionally comprising varying an amount of air to the engine to regulate the output of the engine.

28. The control method as set forth in claim 27 additionally comprising changing a position of a throttle valve to vary the amount of the air.

29. The control method as set forth in claim 28 additionally comprising calculating a position control amount of the throttle valve based upon the actual speed of the watercraft and the target speed of the watercraft, and controlling the position of the throttle valve using the position control amount in the second mode.

30. The control method as set forth in claim 28 additionally comprising determining whether the position control amount is greater than a preset control amount threshold, and controlling the throttle valve using the position control amount if the position control amount is equal to or less than the preset control amount or another position control amount that does not exceed the preset position control amount threshold if the position control amount is greater than the preset position control amount.

31. The control method as set forth in claim 28 additionally comprising sensing an actual position of the throttle valve to generate an actual position signal, calculating a position control amount of the throttle valve based upon the command signal and the actual position signal, and controlling the position of the throttle valve using the position control amount in the first mode.

32. A control method for controlling a speed of a watercraft comprising regulating an output of a prime mover that powers a propulsion device of the watercraft, generating a command signal, sensing an actual speed of the watercraft to generate an actual speed signal, generating a first mode signal that starts a first mode, generating a second mode signal that starts a second mode, generating a target speed signal indicative of a target speed of the watercraft, controlling the regulation of the output of the prime mover based upon the command signal in the first mode, controlling the regulation of the output of the prime mover in the second mode such that an actual speed designated by the actual speed signal generally coincides with a target speed designated by the target speed signal, determining whether the command signal changes while controlling the regulation of the output of the prime mover in the second mode, and controlling the regulation of the output of the prime mover based upon the command signal if the determination is positive.

* * * * *